US007306568B2

(12) United States Patent
Diana

(10) Patent No.: US 7,306,568 B2
(45) Date of Patent: Dec. 11, 2007

(54) METHOD AND DEVICE FOR TREATMENT OF EDEMA

(76) Inventor: Richard Diana, 28332 State Highway 104 NE., Kingston, WA (US) 98346

( * ) Notice: Subject to any disclaimer, the term of this patent is extended or adjusted under 35 U.S.C. 154(b) by 374 days.

(21) Appl. No.: 10/798,713

(22) Filed: Mar. 10, 2004

(65) Prior Publication Data

US 2004/0210176 A1 Oct. 21, 2004

Related U.S. Application Data

(63) Continuation-in-part of application No. 10/643,056, filed on Aug. 18, 2003.

(60) Provisional application No. 60/438,191, filed on Jan. 6, 2003.

(51) Int. Cl.
*A61H 9/00* (2006.01)

(52) U.S. Cl. ..... 601/15; 601/149; 601/151

(58) Field of Classification Search ..... 601/15, 601/21, 22, 104, 107, 148, 149, 150, 151, 601/152; 607/104; 602/13, 75
See application file for complete search history.

(56) References Cited

U.S. PATENT DOCUMENTS 3,548,809 A * 12/1970 Conti ..... 601/152
4,149,529 A * 4/1979 Copeland et al. ..... 601/17
4,338,944 A 7/1982 Arkans
4,552,132 A * 11/1985 Ruscigno ..... 601/152
5,025,781 A 6/1991 Ferrari
5,080,089 A * 1/1992 Mason et al. ..... 601/15
5,314,455 A * 5/1994 Johnson et al. ..... 607/104
5,407,421 A * 4/1995 Goldsmith ..... 602/5
5,411,541 A 5/1995 Bell et al.
5,507,792 A * 4/1996 Mason et al. ..... 607/104
5,672,148 A 9/1997 Maunier
5,718,669 A * 2/1998 Marble ..... 602/5
5,904,145 A 5/1999 Reid
5,906,206 A 5/1999 Shaw et al.
5,916,183 A 6/1999 Reid
5,918,602 A 7/1999 Shaw et al.
5,976,099 A 11/1999 Kellogg
6,179,796 B1 1/2001 Waldridge
6,196,231 B1 3/2001 Reid
6,254,554 B1 7/2001 Turtzo
6,315,745 B1 11/2001 Kloecker
6,338,723 B1 1/2002 Carpenter et al.
6,436,064 B1 8/2002 Kloecker

* cited by examiner

*Primary Examiner*—Danton DeMille
(74) *Attorney, Agent, or Firm*—Christensen O'Connor Johnson Kindness PLLC

(57) ABSTRACT

A therapeutic pad system (200) is disclosed for the treatment of edema, wherein the pressure applied to the user by the pad encourages the proximal flow of lymph. A fluid is provided to one or more bladder-type pads (220) in the pad through an inlet port (218) at a distal end of the pad, and is expelled from the bladder through an outlet port (220) at the proximal end of the bladder, thereby producing a pressure gradient across the pad. The system includes a flexible and compressible liner (250) filled with a number of small foam pieces (258) that is adapted to be wrapped about the therapeutic pad, and a relatively rugged, outer binder (270) that is securable about the liner (250). An advantage of the present system is that it may be applied in a number of different modes and combinations providing many treatment options.

19 Claims, 18 Drawing Sheets

METHOD AND DEVICE FOR TREATMENT OF EDEMA

CROSS-REFERENCES TO RELATED APPLICATIONS

This application is a continuation-in-part of prior application Ser. No. 10/643,056, filed Aug. 18, 2003, priority from the filing date of which is hereby claimed under 35 U.S.C. § 120, and which prior application claims the benefit of Provisional Application No. 60/438,191, filed Jan. 6, 2003, the benefit of which is hereby claimed under 35 U.S.C. § 119, and which applications are incorporated herein by reference.

FIELD OF THE INVENTION

This invention relates to therapeutic compression systems and, in particular, to compression systems for the treatment of edema.

BACKGROUND OF THE INVENTION

The lymphatic system includes lymph vessels, lymph nodes, and lymphoid tissues. Lymphatic fluid, or lymph, is collected from the interstitial spaces and is composed of fluids, organic and inorganic materials, and proteins too large for the venous system. In contrast to the closed-loop blood circulatory system, the lymphatic system works generally on a one-way flow principal. The lymph is first collected at the lymph capillaries that, in turn, drain into larger vessels. The movement of the collected lymph is generally from the more distal portions of the body inwardly toward the various lymph nodes and lymphoid tissues. The motive force for the lymph flow is generally associated with contractions of the adjacent muscles and walls of the larger vessels. Foreign matter and bacteria are filtered at various lymph nodes, after which the fluid enters into the venous system, primarily through the thoracic duct. Approximately one to two liters of lymph fluid drain through this duct every day in a healthy individual.

Edema is defined as the accumulation of excess fluid in a body fluid compartment, which is generally apparent as swelling of the affected area. This fluid accumulation can occur in the cells (cellular edema), in intercellular spaces within tissues (interstitial edema), or in potential spaces or cavities within the body. Edema can be caused by a variety of factors, including conditions that affect osmotic pressure, such as hypotonic fluid overload, which allows the movement of water into the intracellular space, or hypoproteinemia, which decreases the concentration of proteins and permits the passage of fluid out of the blood vessels into the tissue spaces. Edema also commonly results from surgery, injury, and other trauma or stress to the body. Vigorous exercise, for example, engaging in competitive sports, can produce stressors in the body, and particularly, in the joints, which result in edema or localized swelling.

Other causes of edema include poor lymphatic drainage (lymphedema); conditions that cause increased capillary pressure, such as excessive retention of salt and water; heart failure; and conditions that increase capillary permeability, such as inflammation. The swelling associated with edema can, in turn, cause pain and impede wound healing. If left untreated, fibrosis (a hardening of the tissue) may further complicate the drainage process.

Causes of lymphedema include aplasia (lack of development) or hypoplasia (underdevelopment) of the lymphatic system; inflammatory diseases, such as bacterial infections; malignancies, where the lymphatics or lymph nodes can be blocked by tumor cells; surgical removal of various lymph nodes; radiation therapy; local trauma to a limb; and blockage of lymphatics by various parasites. Various system diseases can cause lymphedema, including myxedema, renal disease (such as nephrosis or nephritis), and collagen diseases.

The lymphatic system is a primary system in the body for removal of the excess fluids that produce the edema or swelling. A healthy lymphatic system is therefore necessary for preventing and reducing edema. As noted above, the body's muscle systems motivate or assist in the motivation of lymph through the body toward the lymph nodes. It is known that externally applied compressive forces—for example, as produced with a compressive wrap or bandage—can also assist the lymphatic system in reducing and/or preventing edema. Such compressive therapies are often combined with the local application of ice or other cooling systems, which have also been found to prevent or reduce swelling. Alternatively, in some situations, heating of the affected area may be beneficial to the treatment of edema.

Treatment modalities known in the art include compression sleeves or stockings, pneumatic compression devices, and manual lymph drainage apparatus. U.S. Pat. No. 5,904,145; No. 5,906,206; No. 5,916,183; No. 5,918,602; No. 6,196,231; No. 6,254,554; and No. 6,338,723 disclose various designs for compressive sleeves and wraps for the treatment of lymphedema. The devices generally include a plurality of straps used to tighten the sleeve about the limb of the patient. In U.S. Pat. No. 5,904,145 and No. 6,196,231 (issued to Reid), a partially air-inflated pneumatic bladder is used to adjust the pressure applied by the straps. One of the straps is released and the partially inflated air bladder is inserted underneath the released strap adjacent to the patient's limb. The released strap is then closed and tightened to cause a predetermined increase of pressure to be achieved within the bladder. The strap is then released, the bladder is removed, and the strap is tightened to the same position that existed prior to the bladder being removed. These steps are then sequentially repeated with the remaining straps. In U.S. Pat. No. 6,338,723 (issued to Carpenter et. al.), indicia are used to adjust the compression applied by the straps. The stretch of the elastic material causes increased separation of the indicia. A system measures the separation of the indicia and converts it to compression, based upon the circumference of the body part. These systems are cumbersome to apply. A further disadvantage is the application of a static pressure to the limb.

U.S. Pat. No. 5,025,781 and No. 6,315,745 disclose air inflatable/deflatable compression devices. In U.S. Pat. No. 5,025,781 (issued to Ferrari), the compression device is used with a source of cyclical fluid pressure to provide alternating inflation and deflation cycles. The garment disclosed in U.S. Pat. No. 6,315,745 is formed through the patterned sealing of the layers of the garment at select locations to form air pockets that can selectively apply points of pressure to the affected area. In U.S. Pat. No. 5,976,099 (issued to Kellogg), there is disclosed a static reaction system containing a multiplicity of particles that is pressed against the affected area.

SUMMARY OF THE INVENTION

A therapeutic pad and system for treatment of edema are disclosed wherein the therapeutic pad is secured about a portion of the user for applying a pressure that decreases generally from a relatively high pressure at the distal end to a relatively low pressure at the proximal end. The therapeutic pad includes a bladder defining a flow space for a fluid, an inlet port to the bladder disposed at the distal end of the bladder, an outlet port disposed at the proximal end of the bladder, and securement for securing the therapeutic pad about a portion of the anatomy of a user. The therapeutic pad system includes a pump that provides a fluid under pressure to the inlet port and receives the fluid from the outlet port, such that the fluid flows through the pad from the distal end toward the proximal end, thereby producing a pressure gradient between the distal end of the bladder and the proximal end of the bladder. This pressure gradient encourages the desired proximal flow of lymph in the user. A therapeutic pad system is disclosed utilizing such a distal-to-proximal fluid flow bladder and fluid circulating system in combination with a pump disposed in a fluid circuit with the bladder, the pump operable to circulate the fluid through the bladder, a flexible liner adapted to wrap about the bladder, the liner having a plurality of channels that are substantially filled with foam pieces, and a binder adapted to wrap about the flexible liner, the binder having a plurality of elastic straps In an embodiment of the present invention, the therapeutic pad is used in combination with a flexible and compressible liner that is adapted to be wrapped about the therapeutic pad, and a relatively rugged outer binder that is adapted to be wrapped about the liner, and secured about the portion of the user to be treated.

In an embodiment of the invention, the pump provides a periodic pressure pulse to the fluid such that the pressure pulse moves generally proximally through the therapeutic pad. The duration of the pressure pulse may be, for example, approximately equal to the transit time of the pressure pulse through the therapeutic pad.

In an embodiment of the invention, a control system controls the fluid flow rate through the therapeutic pad. The control system may also control the periodicity of the pressure pulses and/or the temperature of the fluid.

In an embodiment of the invention, the therapeutic pad includes a plurality of bladders, each bladder having a distal inlet port and a proximal outlet port, such that a more complicated pressure profile may be applied to the user. The plurality of bladders may form a unitary pad or may be separately securable to the user. For example, the bladders may be separately engageable, and may be pressurized simultaneously, in series, or independently.

In various exemplary embodiments of the invention, the therapeutic pad is adapted to be secured about a portion of the user—for example, a leg, knee, or shoulder of the user.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Referring now to the figures, wherein like numbers indicate like elements, specific embodiments of the present invention are described in sufficient detail to allow a person of skill in the art to practice the invention.

Figure 1:
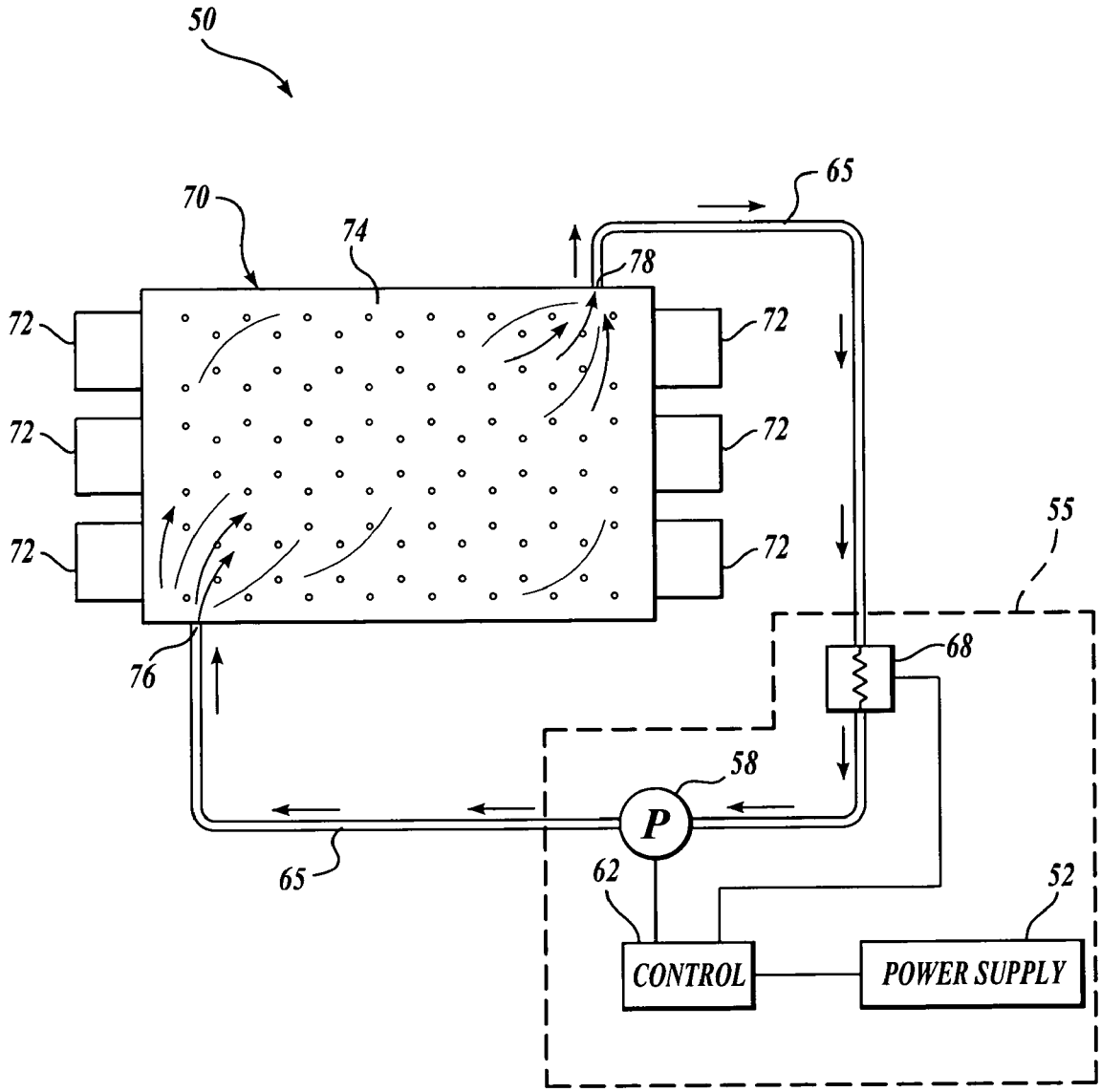
FIG. 1 shows a schematic of a first embodiment of a therapeutic pad system according to the present invention.

FIG. 1 shows a schematic diagram of a first embodiment of a therapeutic pad system 50 in accordance with the present invention, and including a pad 70 having a securement system 72—for example, straps with hook-and-loop type fasteners, adapted to permit the pad 70 to be secured about a portion of the body of a user (not shown), and a bladder 74. The securement system 72 preferably permits the pad 70 to be secured in such a way that a base pressure, $P_0$, may be mechanically provided when the pad 70 is secured to the user.

An inlet port 76 to the bladder 74 is provided at a distal end of the bladder 74, and an outlet port 78 is provided at the proximal end of the bladder 74. Throughout this document, the terms "proximal" and "distal" refer in general to the portion of the referenced element that is directed toward the "proximal" or "distal" portion, respectively, of the user when the system is in use, and wherein the lymph is understood to generally flow from a relatively distal portion of the user's anatomy to a relatively proximal portion. In other words, the therapeutic pads disclosed herein are intended to be applied to the user such that the direction from the distal end of the pad to the proximal end of the pad is generally in the direction of the lymph flow in the user.

The bladder 74 receives a fluid through the inlet port 76. The fluid flows proximally through the bladder 74 and exits through the outlet port 78. A pump 58 provides a pressure or motive force for circulating the fluid through the bladder 74. In this exemplary embodiment, a thermal modulator such as a heat exchanger 68 is provided to cool or heat the circulating fluid, whereby the therapeutic pad 70 can apply a thermal therapy simultaneously with a pressure therapy, as discussed below. A control 62 communicates with the pump 58 and optionally with the heat exchanger 68 to control the timing, duration, flow rate, applied force, and temperature of the circulating fluid. A power supply 52—for example, a battery system, external power source, or the like—provides power to the pump 58, control 62, and heat exchanger 68. The power supply 52, pump 58, control 62, and heat exchanger 68 may be conveniently provided in a single, portable console 55 (shown schematically in FIG. 1), that is connected to the therapeutic pad 70 with appropriate tubing 65.

It will be appreciated that the bulk fluid flow through the bladder 74 is generally one way—that is, from the inlet port 76 at the distal end of the bladder 74 to the outlet port 78 at the proximal end of the bladder 74. When the therapeutic pad 70 is properly secured about a portion of the user, pumping fluid through the bladder will produce a hydraulic pressure in the bladder 74, thereby increasing the pressure that is applied by the therapeutic pad 70 to the user. It will be appreciated by a person of skill in the art that the hydraulic pressure will exhibit a pressure gradient across the bladder 74 from a relatively high pressure, $P_H$ (see FIG. 2), at the inlet port 76, to a relatively low pressure, $P_L$, at the outlet port 78. The pressure gradient results naturally from the fluid flow through the bladder 74, including the restricting structures interior to the bladder 74 described below. The flow of a viscous fluid is generally described by the Navier-Stokes equations of fluid mechanics. In general, the momentum flux and flow rate are proportional to the pressure gradient between the inlet and outlet ports. It is a fundamental property of a fluid that in the presence of a pressure gradient, a fluid will flow in the direction from a relatively high pressure toward a relatively low pressure. In the therapeutic pad system 50, the pump 58 provides a motive pressure to drive the fluid through the bladder 74. Viscous and hydrodynamic forces in the bladder 74 will hinder the fluid flow, resulting in a pressure drop across the bladder 74.

Figure 2:
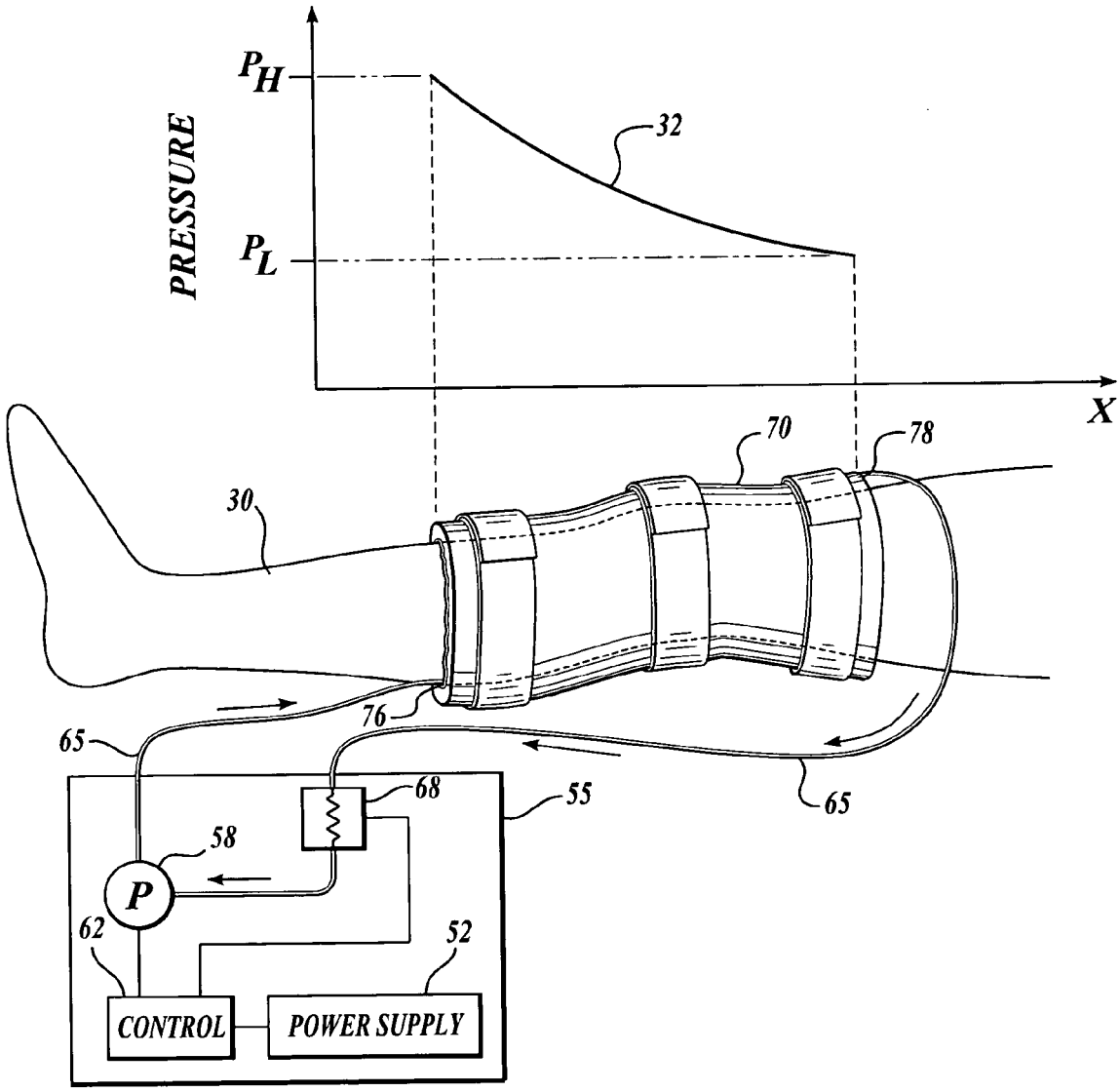
FIG. 2 illustrates the therapeutic pad system of FIG. 1, applied to the limb of a user, and showing in general an idealized steady-state pressure profile applied by the pad to the user.

It is contemplated by the present invention that the pump 58 may be controlled to pump the fluid continuously through the bladder 74 at a relatively constant pressure head. FIG. 2 depicts the therapeutic pad system 50 of FIG. 1, applied to a limb 30 of a user, and showing a steady-state, or time- and transversely-averaged pressure profile 32 along the length of the pad 70, wherein the highest pressure, $P_H$, is at the inlet port 76, and the lowest pressure, $P_L$, is at the outlet port 78. The details of the pressure profile 32 may vary based on a number of factors but will, in general, monotonically decrease along the length of the pad 70, along the direction of the fluid flow. The pad 70 therefore produces a desired pressure profile 32 applied to the user along the length of the pad 70, wherein the pressure is greater at the distal end, and less at the proximal end, thereby providing a compressive force to the user that encourages a generally proximal lymph flow.

Figure 3:
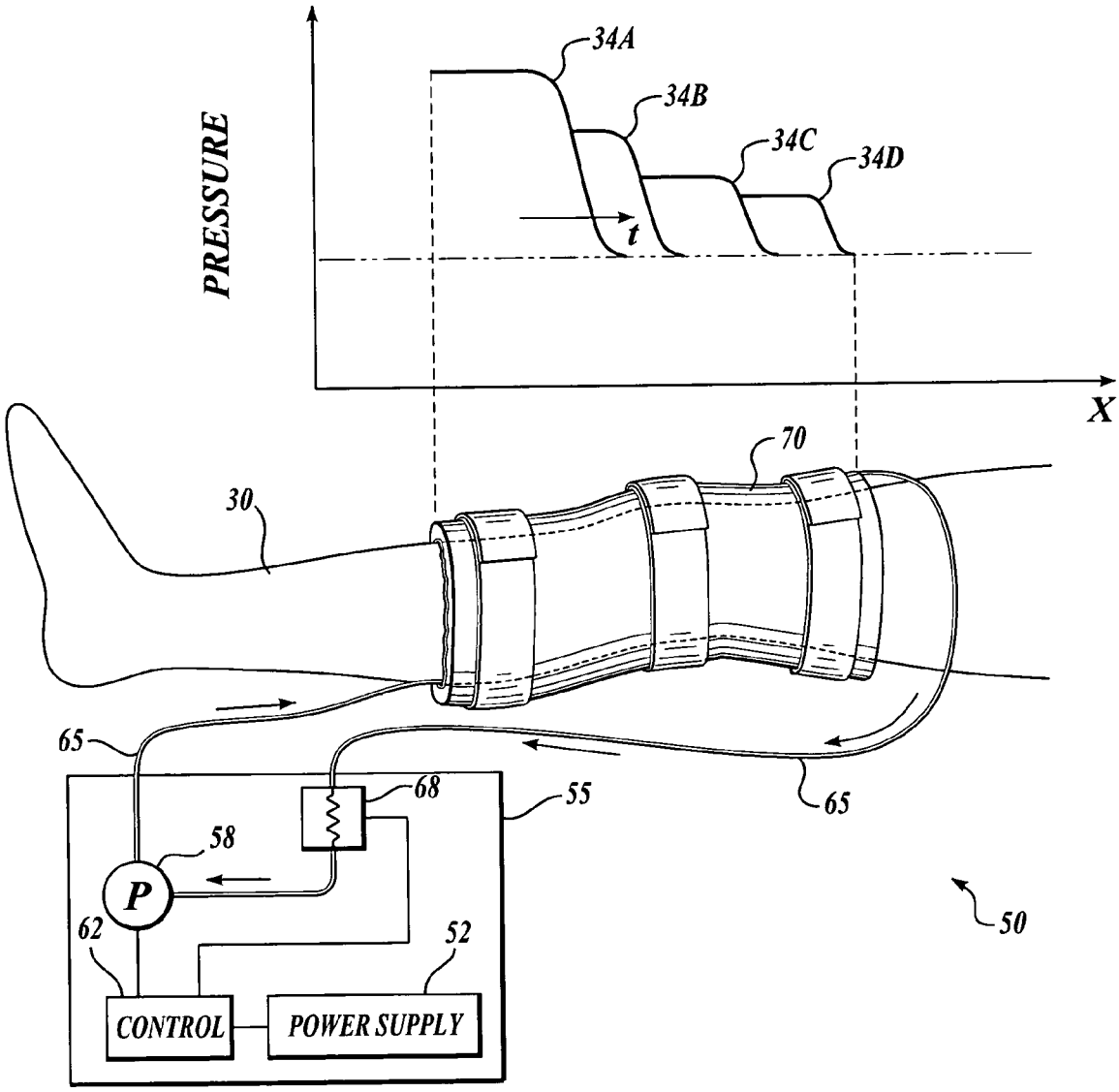
FIG. 3 illustrates the therapeutic pad system of FIG. 1, applied to the limb of a user, and showing in general an idealized transient pressure profile applied to the user when a pulsed fluid pressure is applied.

It is also contemplated that the pump 58 may provide a time-varying driving pressure to the fluid—for example, to provide a periodic pressure ramp or pulse through the pad 70. FIG. 3 depicts the therapeutic pad system 50 of FIG. 1, applied to a limb 30 of a user and showing a transversely-averaged transient pressure pulse 34A, 34B, 34C, 34D passing through the bladder 74, where the arrow indicates the temporal direction. It will be appreciated that, as the pressure pulse 34A-34D passes through the bladder, a compressive pressure is applied to the user, moving generally along the length of the pad 70, from a distal position to a proximal position. This moving pressure pulse will further encourage the desired proximal lymph flow generally along the length of the pad 70. It will be appreciated that the "pulse" depicted may be a step increase in pressure that lasts for approximately the transit time of the pulse across the pad 70, thereby discouraging any localized reverse flow in the pad.

Figure 4:
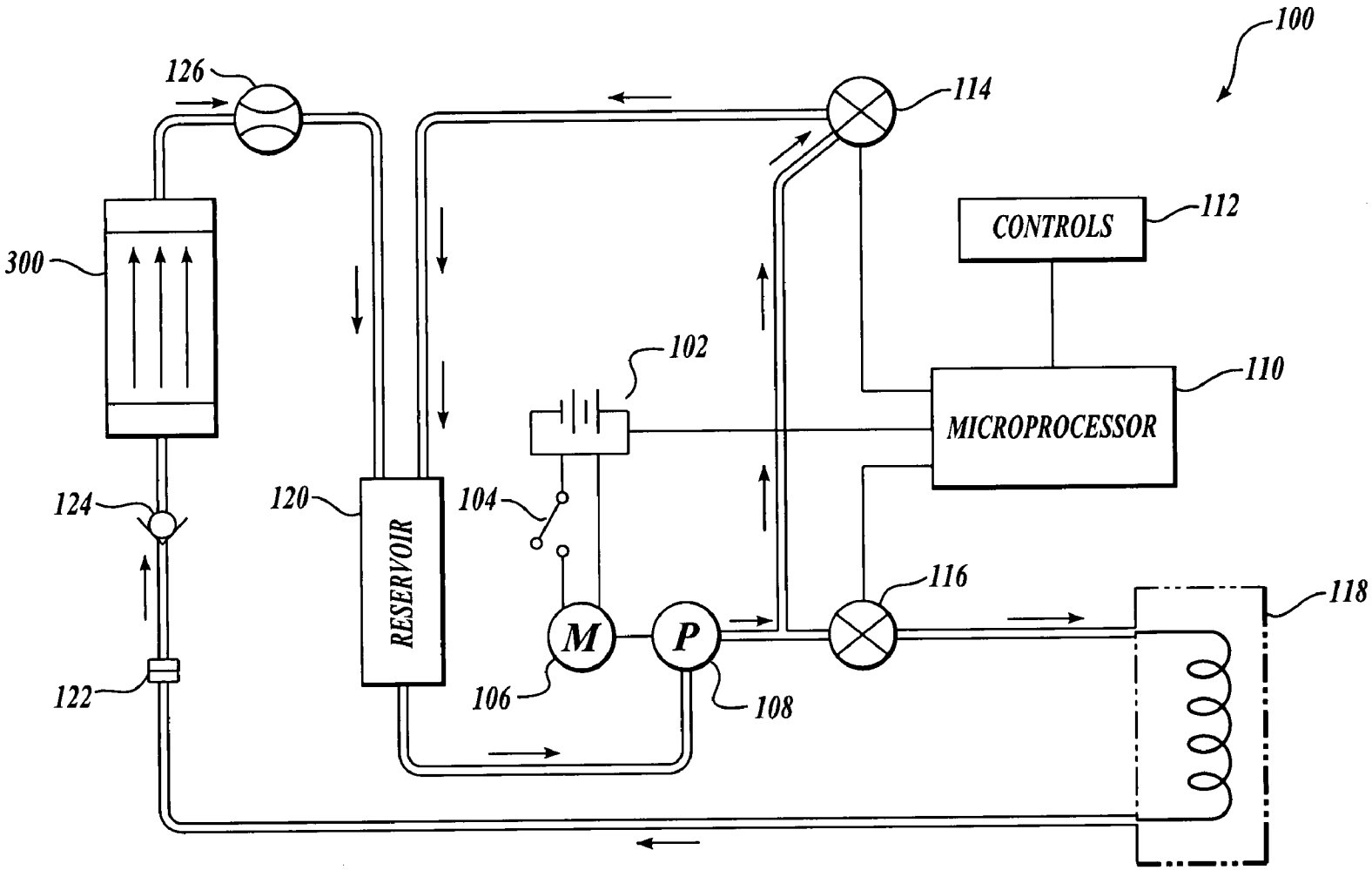
FIG. 4 illustrates a schematic of a second embodiment of a therapeutic pad system according to the present invention.

FIG. 4 shows a schematic of another embodiment of a therapeutic pad system 100 according to the present invention. In the embodiment shown in FIG. 4, a motor 106 powered by a battery 102 through switch 104 drives pump 108. The inlet of the pump 108 communicates with a reservoir 120. A filter (not shown) may be positioned between the reservoir 120 and the pump 108. The outlet of the pump 108 communicates with either a heat exchanger 118 or the reservoir 120, depending upon the status of valves 114 and 116. The valves 114 and 116 may be any suitable valve type—for example, solenoid valves are currently a preferred valve type. When solenoid valve 114 is closed and solenoid valve 116 is open, the outlet of the pump 108 communicates with the heat exchanger 118, coupling 122, check valve 124, flexible therapeutic pad 300, flow restrictor 126, and reservoir 120. Alternatively, when solenoid valve 114 is open and solenoid valve 116 is closed, the pump 108 communicates directly with reservoir 120, which bypasses the heat exchanger 118 and the therapeutic flexible pad 300. Microprocessor 110 controls the opening and closing of the solenoid valves 114 and 116. The flow restrictor 126, cooperatively with the pump 108, creates a back pressure, thereby causing the inner and outer layers of the therapeutic pad to balloon outward. As will be described in detail later, the therapeutic pad 300 contains a plurality of weld spots. During use, the back pressure causes the regions of the therapeutic pad 300 between the weld spots to balloon inwardly, toward the user's skin, as well as outwardly toward the outer, elastic binder.

Pump 108 is operatively connected to a motor 106. The pump 108 has inlet and outlet ports (not shown) that may be substantially identical. The inlet port of pump 108 may be connected by means of a short section of PVC or similar tubing to a connector elbow of the reservoir 120 outlet. In a similar manner, the outlet port of pump 108 is connected using a short section of PVC or similar tubing to a connector elbow. By way of example, the tubing used has an internal diameter of 3/16 inch.

In the exemplary embodiment, the pump is a 24-Volt DC pump, model number UGP-2010P, manufactured by B & D Pumps. This pump is generally capable of providing up to 16 gallons per hour of fluid flow at an applied voltage of 12-volt DC. The power source for the motor may be a battery or 12-volt power supply. The power supply may be connected to any conventional household outlet, and is provided with the appropriate transformer.

Figure 5:
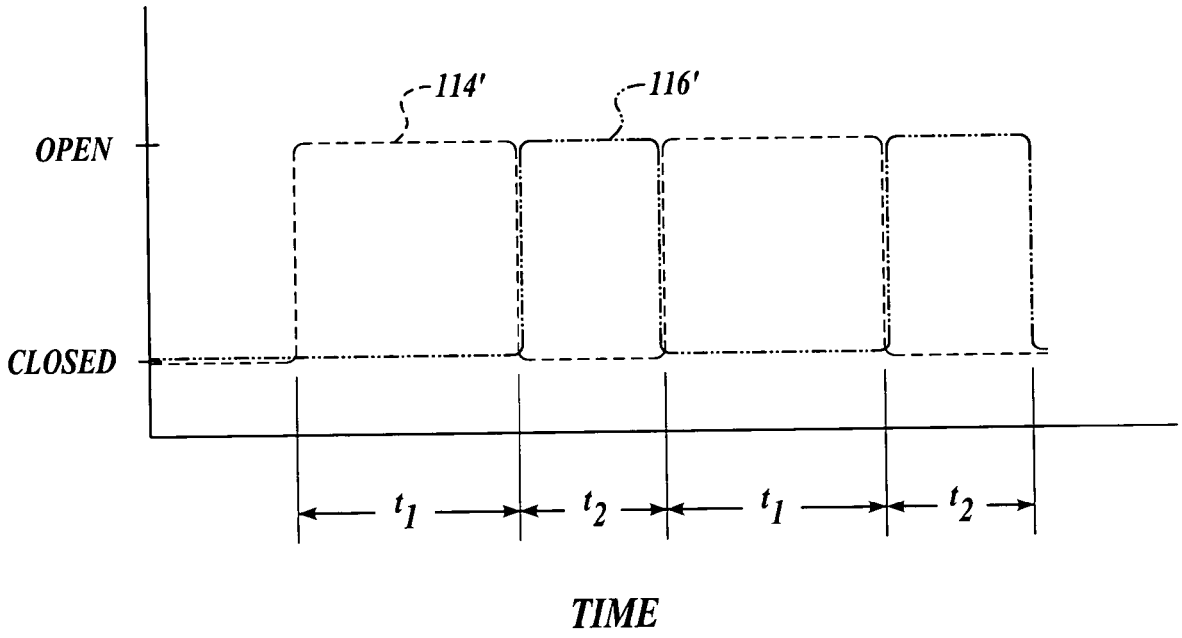
FIG. 5 illustrates a general representation of a representative timing sequence of the solenoid valves for the system of FIG. 4.

FIG. 5 shows schematically a typical timing sequence for solenoid valves 114 and 116. In this timing sequence 114', 116' solenoid valve 114 is open when solenoid valve 116 is closed, and vice versa. The open time for solenoid valve 114 is designated as $t_1$, and the open time for solenoid valve 116 is designated as $t_2$. Open times $t_1$ and $t_2$ are not necessarily equal. During the cycle in which solenoid valve 114 is closed and solenoid valve 116 is open, the fluid travels through the heat exchanger 118 and then through the therapeutic pad 300 from the inlet port located in the distal aspect of the affected limb to the proximal outlet port, thereby moving interstitial fluid in a distal to proximal direction. It is possible to choose the open time of solenoid valve 116 to approximate the transit time of the fluid through therapeutic pad 300.

During the portion of the cycle 114' in which solenoid valve 114 is open and solenoid valve 116 is closed, the pump communicates with the bypass circuit through reservoir 120. The backward flow of fluid from therapeutic pad 300 is prevented by check valve 124. Therefore, the fluid in the therapeutic pad will be propelled forward by the inertia in the fluid supplied by the pressure gradient established during the flow cycle through the therapeutic pad. In this embodiment of the present invention, therefore, the closed time of solenoid valve 116 (equivalent to the open time of solenoid valve 114) may be selected to be approximately equal to the time for the majority of fluid to flush through the therapeutic pad 300.

The heat exchanger 118 regulates the temperature of the inlet fluid to the therapeutic pad 300. The temperature of the circulating fluid can be regulated to produce either a cooling or heating effect upon the limb being treated, or can approximate ambient temperature, whereby the fluid will produce neither a significant cooling nor heating effect upon the limb. Local hyperthermia has been shown to have a beneficial effect on edema (see Liu et. al., *Lymphology* 26(1):28-37, March 1993). In this study, the influence of microwave and hot water immersion hyperthermia on edema and edematous skin of the leg was studied in twelve patients. Whereas heating was associated with a reduction in girth and volume of the leg, lymph flow was found to be unchanged. Histologically, the edematous skin after heat treatment showed near resolution of perivascular cellular infiltration, disappearance of "lymph lakes" and dilatation of blood capillaries. It was concluded that the subsidence of local inflammation in the edematous limb with alteration in the extracellular protein matrix after regional heating accounted for the reduction in peripheral edema.

It has been recognized that there is an advantage to the patient's limb remaining cool while wearing a compressive sleeve on the limb. It is well known, however, that a large temperature differential between the fluid in the therapeutic pad and the normal body temperature may lead to patient discomfort, and can decrease thermal coupling by causing constriction of blood vessels in the treated limb. For example, the temperature of the circulating fluid for cooling may vary between 32 and 70° F.—the preferred temperature range is between approximately 50 to 70° F.

Heat exchanger 118 may be any standard fluid loop heat exchanger. By way of example, cooling can be accomplished by immersing heat exchange coils containing the circulating fluid into a mixture of ice and water (not shown). This approach is inexpensive and has the added advantage of portability. Any other suitable cooling system may alternatively be used. For example, the coolant system can utilize a vapor-compression refrigeration system, thermoelectric cooling, or heat pipe technology. In a conventional refrigeration system, the main working parts are the evaporator, condenser, and compressor. Thermoelectric cooling, also called the "Peltier Effect," is a solid-state method of heat transfer through dissimilar semiconductor materials. Heat pipes passively transfer heat from the heat source to a heat sink where the heat is dissipated.

Alternatively, if heat therapy is to be utilized, the circulating fluid may be heated. Heating a fluid may be accomplished, for example, using any of several types of electric heaters. Some heaters physically lend themselves to direct immersion in the fluid, while others are better suited for heating a pipe or vessel containing the fluid.

In the disclosed embodiment of FIG. 4, the circulating fluid may be deionized distilled water or a mixture of deionized distilled water and a fluid, such as isopropyl or rubbing alcohol or other suitable components, to lower the freezing point of the circulating fluid when such fluid is used for cooling. The concentrations by volume of the components, for example, may range from 60 to 90% deionized distilled water and 40 to 10% isopropyl alcohol. The presently preferred embodiment uses a mixture of about 80% deionized distilled water and about 20% isopropyl alcohol. Other components may also be added, such as iodine or another bacteriostatic agent and/or a surfactant to reduce the formation of bubbles.

A control panel 112 (see FIG. 4) may include any number of suitable controls. For example, the control panel 112 may include an on/off switch, a control for controlling the on/off timing cycles of the solenoid valves, a control for setting the temperature of the circulating fluid, and a fluid temperature display. The solenoid valve timing cycles may be preprogrammed—for example, such that the adjustment dial refers to specific therapeutic pads for the lower and upper extremities. The on/off times of the solenoid valves may approximate the transit time through the therapeutic pad and the time to flush the fluid through the pad when the pump communicates with the bypass circuit.

Figure 6:
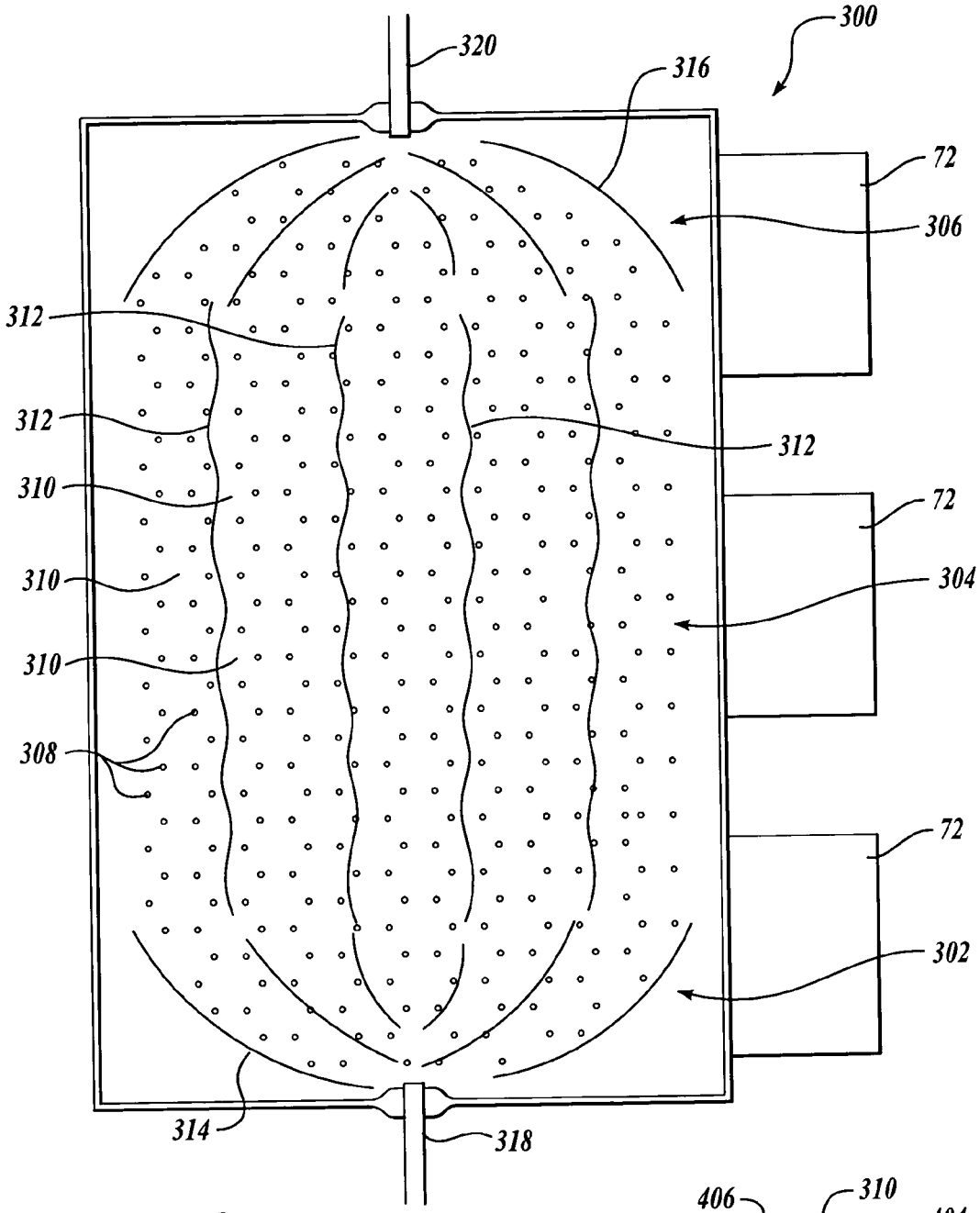
FIG. 6 illustrates a plan view of an embodiment of the flexible therapeutic pad for the system shown in FIG. 4.

FIG. 6 shows one embodiment of the therapeutic pad 300. Although the shape of the pad 300 is rectangular in this figure, other shapes for the therapeutic pad are also contemplated, including several specific examples that are discussed below. The simple, rectangular design of FIG. 6 may be suitable for use on portions of the anatomy that do not encompass a joint. Pads that are intended to be used over a joint will typically have more complex shapes in order to permit the pad to remain in contact with the limb during movement of the joint.

The circulating fluid enters therapeutic pad 300 through inlet port 318 and exits through outlet port 320 disposed generally opposite the inlet port 318, whereby the flow through the pad 300 is on average one way through the pad. The inlet and outlet ports may be fabricated from any suitable material—for example, plastic tubing or metal fittings. The inlet port 318 is positioned in the distal aspect of the limb being treated and the outlet port 320 is positioned proximally on the limb.

Therapeutic pad 300 is preferably fabricated of two superposed sheets of a flexible, waterproof material, such as polyurethane, rubber, or a synthetic form of rubber. The sheets may also be fabricated from a fabric coated with an elastomer, such as polyurethane-coated nylon. The sheets are joined together at the edges by suitable means, such as RF welding, heat welding, or otherwise bonded as desired. Spaced-apart heat-sealed lines 312 and spot bonds or welds 308 are also formed during the heat sealing process. The spot welds typically range in diameter from ⅛ inch to ¼ inch, with the spacing between spot welds typically varying between ¼ inch to ½ inch. The spot welds may be uniformly or randomly distributed throughout the therapeutic pad. The therapeutic pad 300, as shown in FIG. 6, represents one preferred embodiment of the present invention and is generally intended for an area on the limb that does not encompass a joint. Other shapes are possible and contemplated by the present invention. For example, more complex shapes intended for use on the thigh, knee, and shoulder joints are disclosed later.

The therapeutic pad 300 includes a bladder defining three distinct sections—an inlet manifold 302, a center section 304, and an outlet manifold 306. The inlet manifold 302 is in fluid communication with the inlet port 318 and center section 304. The outlet manifold 306 is in fluid communication with the center section 304 and the outlet port 320.

Heat seal lines 314 in inlet manifold 302 are oriented to direct the circulating fluid from inlet port 318 toward each of the spaces 310 in the center section 304 of therapeutic pad 300 formed by the heat seal lines 312. Heat seal lines 316 in outlet manifold 306 are oriented to direct the circulating fluid from each of the spaces 310 in the center section 304 of therapeutic pad 300 toward outlet port 320. It will be appreciated that although the seal lines 312 are shown as individually continuous lines, intermittent seal lines 312 are also contemplated by the present invention, and may provide in advantages such as greater flexibility, and more even transverse pressure distribution. Similarly the seal lines may be wider than shown, and/or may be of more complex shape, to produce the desired flow pattern.

The seal lines 312 and spot bonds or welds 308 form the spaces 310 that direct the circulating fluid from inlet manifold 302 to outlet manifold 306 along generally parallel paths. The seal lines 312 are shown with ripples to reduce eddy currents adjacent to the lines. Spot welds 308 are distributed generally throughout the therapeutic pad 300. Without the spot welds 308, the sections between adjacent heat lines 312 will undesirably balloon out in response to the fluid pressure since the inner and outer layers of the bladder are fabricated from flexible materials. The regions between the spot welds 308 will also balloon out in response to fluid pressure, creating a plurality of projections against the skin. It will be apparent to persons of skill in the art that the resulting projections or protuberances in the bladder that define flow paths for the circulating fluid produce localized high- and low-density regions, producing a pattern of relatively high and low pressures applied to the body part that the therapeutic pad 300 is applied to, which is believed to produce or promote localized interstitial flow paths to promote fluid movement and thereby reduce swelling.

Figure 7:
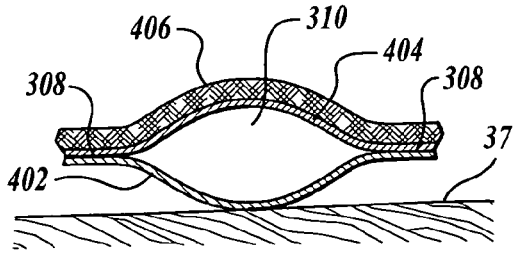
FIG. 7 shows a fragmentary cross-sectional view through one pair of spot welds in the therapeutic pad and the fluid-filled region between the spot welds.

FIG. 7 shows a representative region of the space 310 between two spot welds 308 of the pad 300. The inner layer 402 and the outer layer 404 of the therapeutic pad are shown expanded in response to the fluid pressure. At least a portion of the inner layer 402 of the therapeutic pad remains in contact with the user's skin 37. The outer layer of the therapeutic pad expands in an outward direction, depending upon the properties of outer wrap 406. The outer wrap 406 will be discussed in greater detail later. In the exemplary embodiment shown, the thickness of the space 310 may range from 1/16 to 1/2 inch. In a preferred embodiment, the thickness will range from 1/8 to 3/8 inch.

The outer wrap 406 may be fabricated from any suitable material, preferably an elastic woven fabric. Furthermore, in some applications, it may be advantageous that the outer wrap 406 be anisotropic, i.e., having a greater elongation axially than radially. In contrast to compression sleeves used in the treatment of edema, the present invention does not rely solely on radial compression from the outer wrap 406 to reduce the degree of edema. Rather, the present invention provides a directional pressure gradient that may be time-varying, to promote a distal-to-proximal lymph flow, combined with a high-low pressure distribution to stimulate the movement of biological fluids. When placed on a limb, the ability of the outer wrap 406 to elongate in an axial direction provides improved form and fit when the limb is moved while the therapeutic pad is in place, particularly when the therapeutic pad spans a joint, such as the knee or elbow.

The outer wrap 406 may be fashioned to secure the therapeutic pad about the desired portion of the user's anatomy. It will be appreciated that the properties of the outer wrap 406 may be selected by using fabrics having the desired properties.

The seal lines 312 are shown to be generally parallel to each other in FIG. 6. In the preferred embodiment, the seal lines 312 are oriented to approximately follow the direction of physiologic lymph flow when the pad 300 is in use.

It should be appreciated that by locating the inlet and outlet ports 318, 320 generally at opposite ends of the pad 300, the substantially unidirectional flow in the pad 300 may be directed to flow along the user's natural lymphatic pathways, as discussed below, thereby generating a desired pressure profile that directs flow generally toward the lymphatic nodes.

Figure 8A:
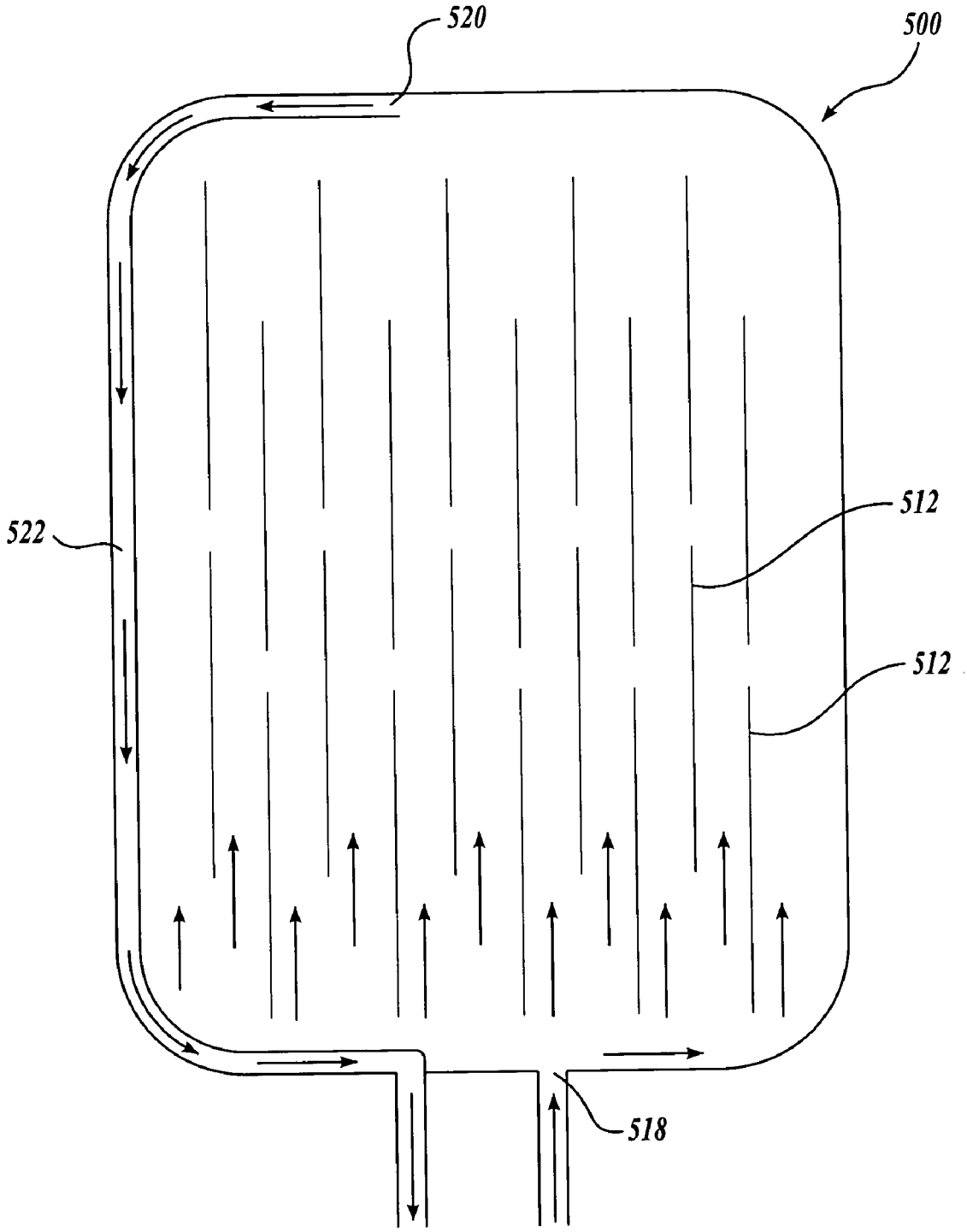
FIGS. 8A and 8B show the plan views of alternative embodiments of the therapeutic pad of the present invention, wherein a fluid return flow channel is incorporated into a periphery of the pad.
Figure 8B:
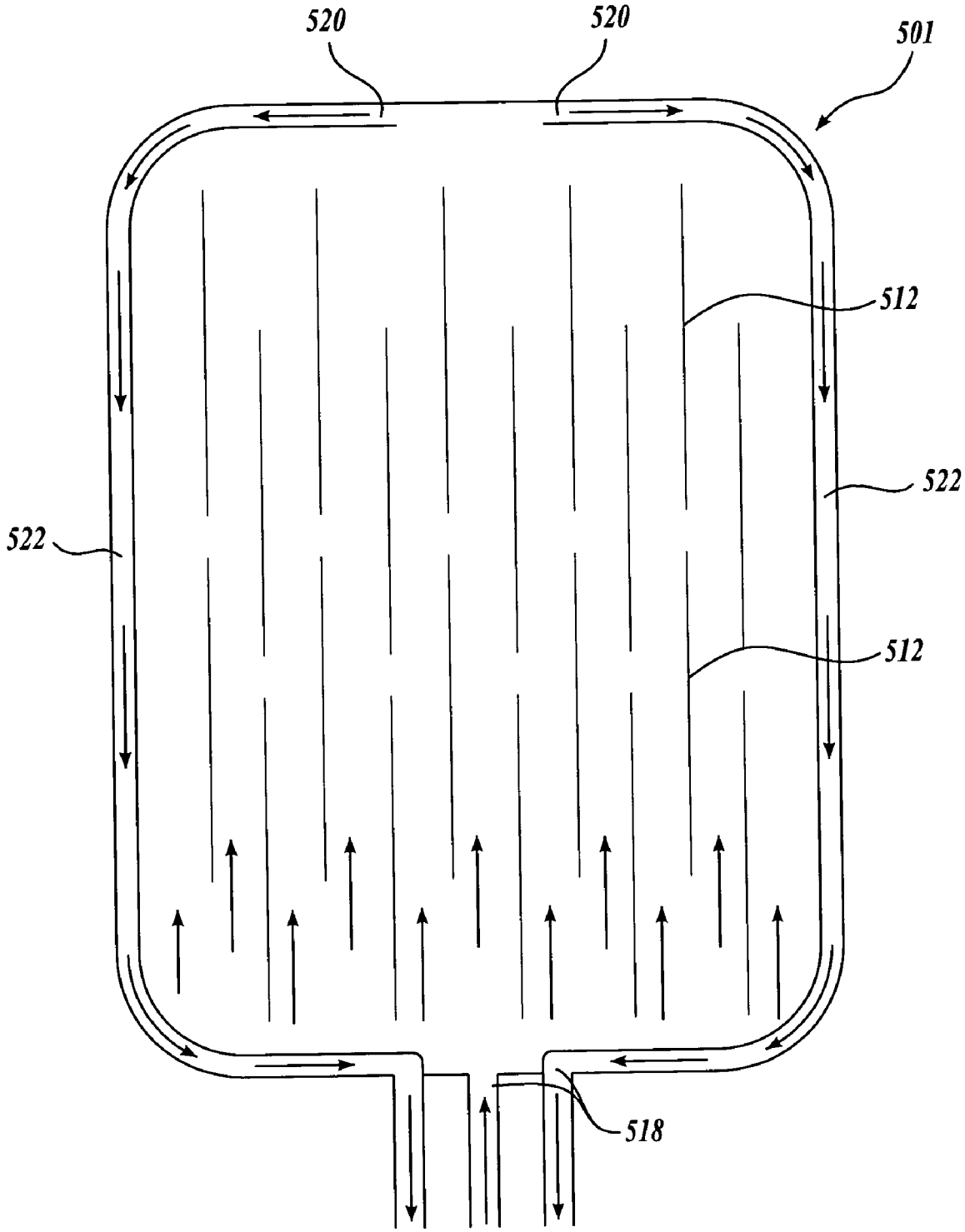

As shown in FIGS. 8A and 8B, a fluid return channel 522 may be incorporated into a therapeutic pad 500, 501 such that the circulating fluid may be collected near the fluid inlet port 518. In these alternate embodiments, the inlet port 518 is disposed at the distal end of the therapeutic pad 500, and the outlet port 520 is disposed internally at the proximal end of the therapeutic pad 500, 501. It will be appreciated that the fluid flow within the pad 500, 501 is still distal-to-proximal, as indicated by the arrows, producing the desired pressure profile qualitatively as shown in FIG. 2. Appropriate heat seal lines 512 and/or spot welds (not shown) define flow channels within the pad 500, 501 as discussed above. It is also contemplated that alternatively the inlet port may be disposed internally, with a supply line disposed internally to the pad, as long as the fluid flow through the pad is effectively distal to proximal when the pad is properly applied to the user.

Figure 9A:
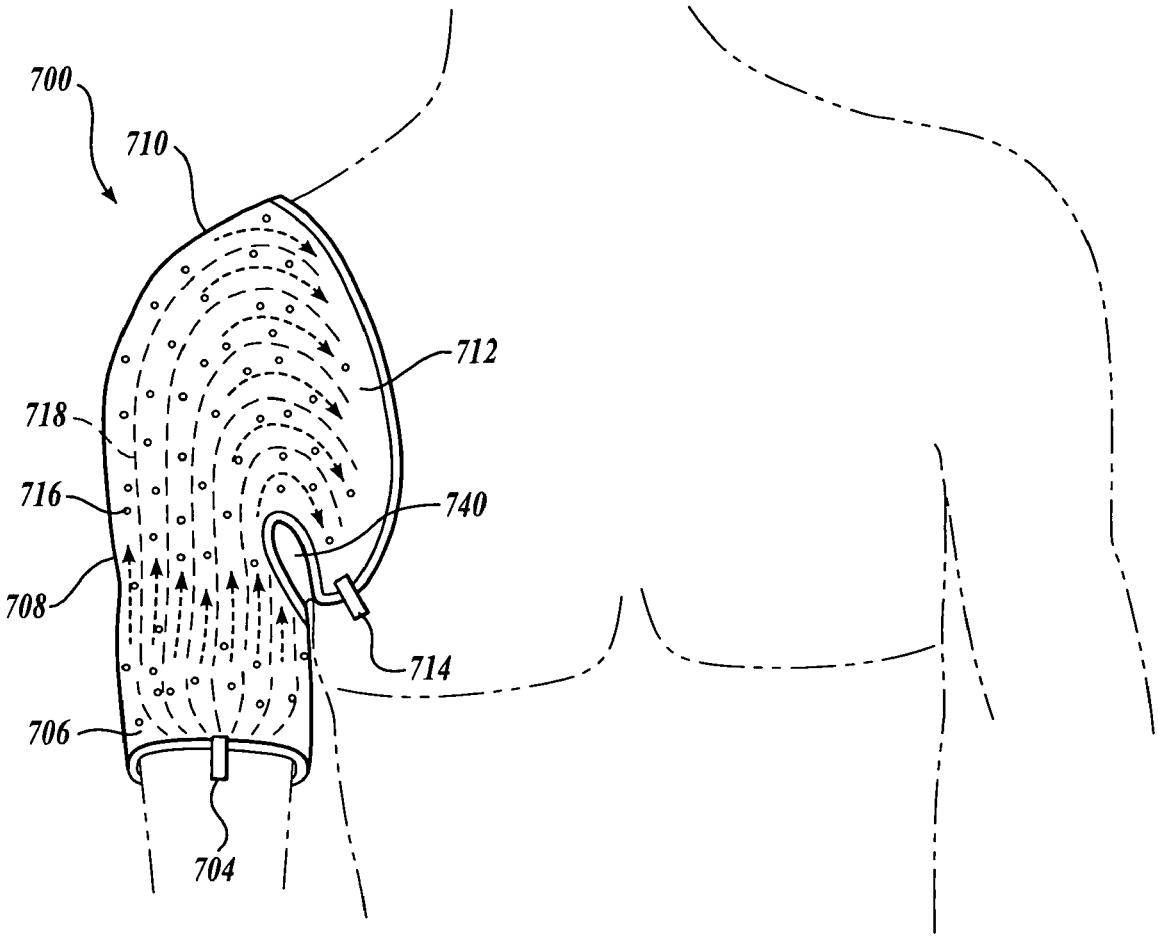
FIGS. 9A and 9B show an embodiment of the therapeutic pad adapted for the upper arm and shoulder.
Figure 9B:
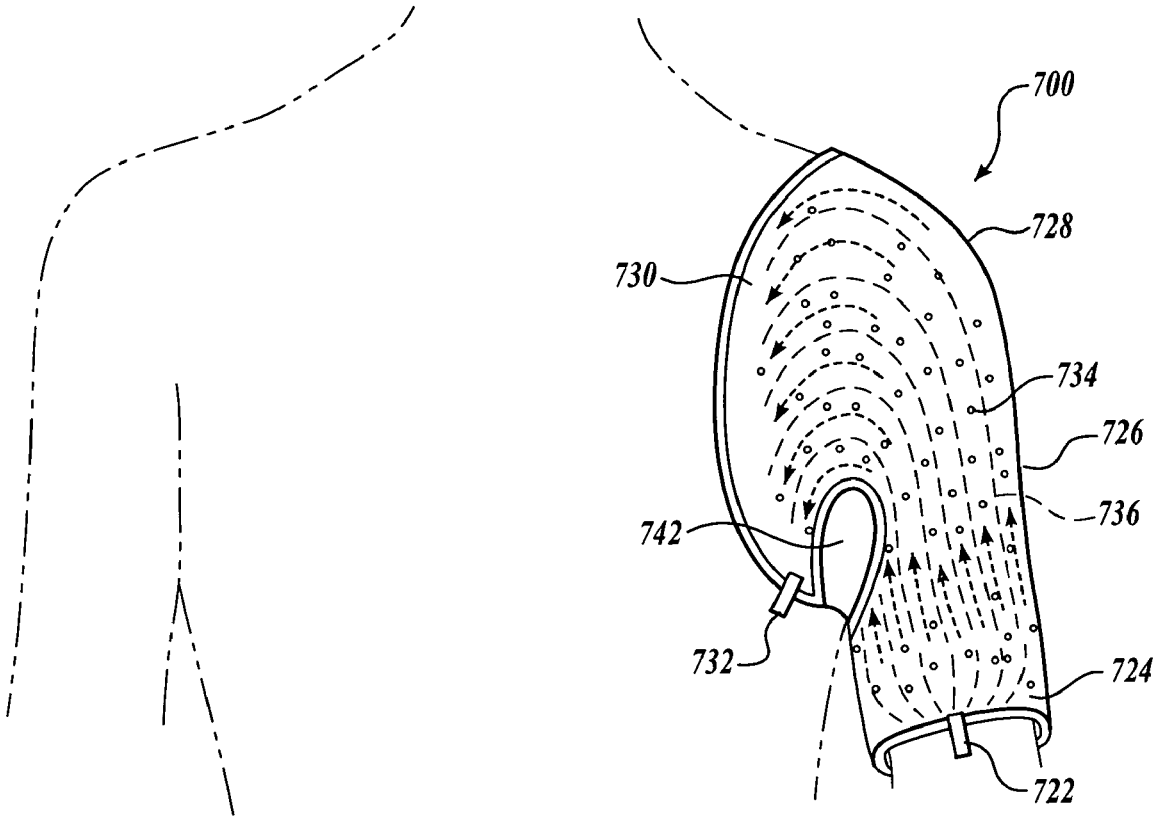

FIGS. 9A and 9B show the general features of the therapeutic pad 700 for the upper arm and shoulder. FIG. 9A shows a palmar view of pad 700, and FIG. 9B shows a dorsal view of pad 700. The therapeutic pad 700 includes inlet ports 704 and 722, inlet manifolds 706 and 724, upper arm sections 708 and 726, anterior shoulder flap 710, and posterior shoulder flap 728. A pair of slits 740 and 742 extends from the axilla toward the shoulder in both the anterior and posterior shoulder flaps to facilitate conformity of the flaps with the shoulder and upper chest. The slits may extend further from the axilla toward the shoulders than is shown in FIGS. 9A and 9B. In one embodiment, the anterior shoulder flap 710 crosses the clavicle at approximately the midpoint and extends over the antero-lateral chest toward the axilla, and the posterior shoulder flap 728 crosses the outer third of the clavicle and extends over the region of the scapula toward the axilla. The shapes of both the anterior and posterior flaps can vary. By way of example, the anterior flap 710 may extend further anteriorly to encompass a greater portion of the anterior chest wall. Likewise, the posterior flap can extend further toward the midline, encompassing a greater portion of the scapular region.

The circulating fluid enters the therapeutic pad 700 through inlet ports 704 and 722. The circulating fluid is introduced through two inlet ports 704 and 722 and two manifolds 706 and 724 to provide more uniform distribution of the circulating fluid over the palmar and dorsal aspects of the arm and shoulder. The inlet ports 704 and 722 may be fluidly interconnected with a Y-connector (not shown) which, in turn, communicates with the fluid circuit shown in FIG. 4. The manifolds 706 and 724 distribute the circulating fluid uniformly from the inlet ports 704 and 722 to the upper arm sections 708 and 726 of the therapeutic pad 700. Alternatively, only a single inlet port and manifold may be used, or more than two inlet ports and/or manifolds may be used. The heat seal lines 718 and 736 direct the flow of the circulating fluid generally along the lymph territories of the upper arm and shoulder.

It is known in human physiology that the radial and ulnar lymph trunks of the forearm largely join to form the medial lymph trunks of the upper arm, which primarily drain into the axillary nodes. Some of the radial lymph trunks join the lateral trunks of the upper arm, which drain into the supra- and sub-clavicular nodes. The heat seal lines 718, 736 of the disclosed embodiment are generally arranged to be uniformly spaced and parallel to one another in the upper arm. The fluid flow over the medial aspect of the upper arm is directed toward the axilla. The fluid flow over the anterior and lateral aspects of the upper arm is directed toward the sub-clavicular and supra-clavicular regions, corresponding to the pattern of lymph flow. Posteriorly, the fluid flow is largely directed toward the axilla, again corresponding to the pattern of lymph flow.

Spot welds 716, 734 are provided throughout the therapeutic pad. As discussed above, the heat seal lines 718, 736 and spot welds 716, 734 operate to distributed the circulating fluid from inlet ports 704 and 722 through manifolds 706 and 724 relatively uniformly through the upper arm sections 708 and 726, and through anterior shoulder flap 710 and posterior shoulder flap 728. The fluid exits the therapeutic pad through outlet manifolds 712, 730 and outlet ports 714 and 732, and circulate, for example, through the fluid circuit shown in FIG. 4. The outlet ports for both the anterior and posterior flaps are positioned near the axilla, since in both cases, the circulating fluid drains toward the axilla. The arrows indicate the general flow direction within the pad 700.

Figure 10:
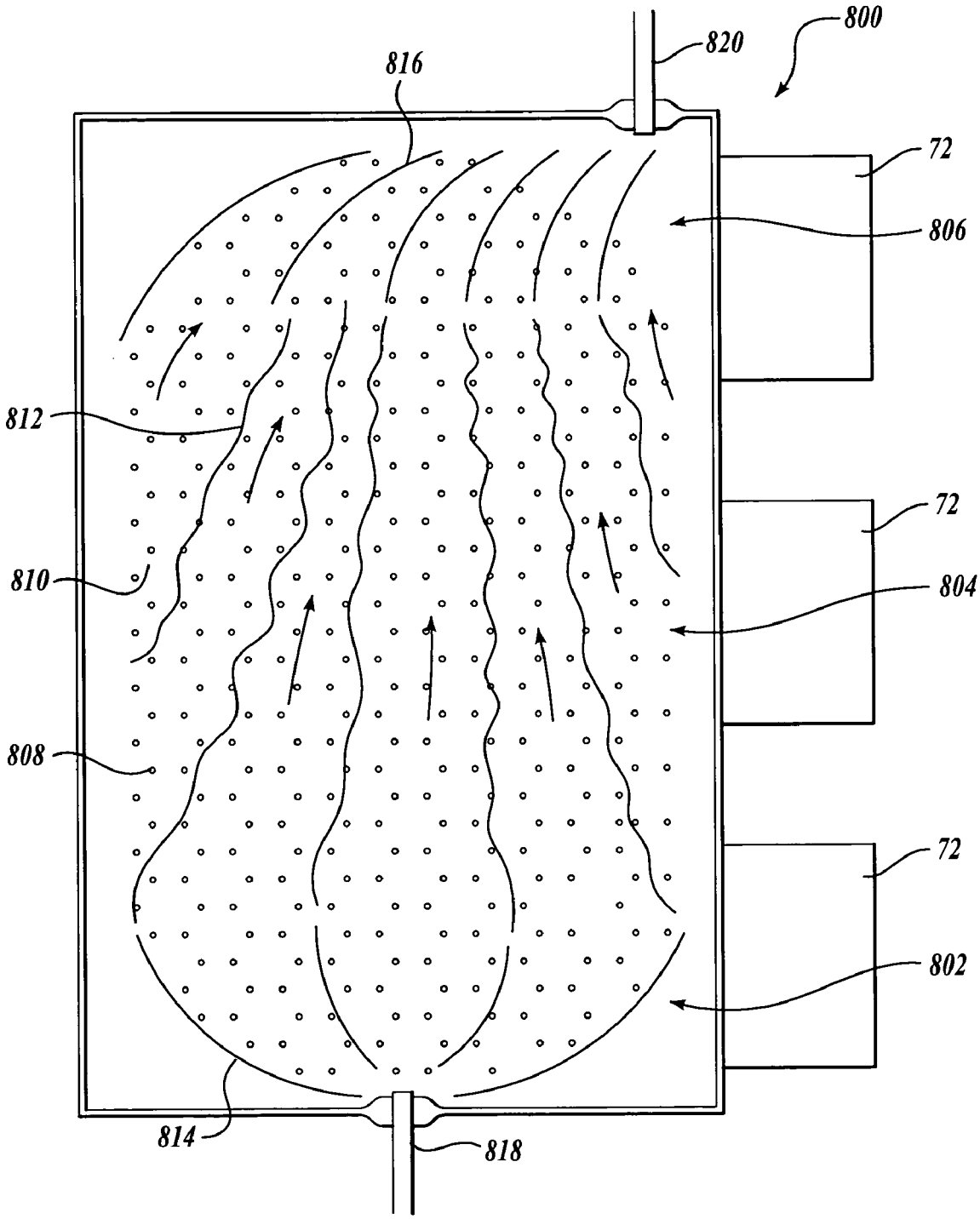
FIG. 10 shows an embodiment of the therapeutic pad of the present invention adapted for the thigh.

FIG. 10 shows an embodiment of a therapeutic pad 800 for the treatment of edema affecting the thigh, specifically the right thigh, according to the present invention. The general features are similar to those of FIG. 6 and will not be reiterated in detail here. Lymph drainage from the anterior thigh drains generally into the inguinal nodes. Lymph drainage from the medial and lateral thigh converges toward the anterior thigh and also drains into the inguinal nodes. The inlet port 818 of pad 800 is located such that in use, it is on the distal aspect of the thigh, and the outlet port 820 is located proximally. The inlet manifold 802 is designed to distribute the flow throughout the center section 804 of the pad 800. Seal lines 814 are provided in the inlet manifold 802 to distribute the inlet flow, and seal lines 816 in the outlet manifold 806 direct the flow toward the outlet port 820. Seal lines 812 and spot bonds 808 similarly define flow channels 810 in the center section 804 of the therapeutic pad 800.

The therapeutic pad 800 is designed to direct the flow of circulating fluid toward the inguinal nodes. The outlet port 820 is off center, since the flow of circulating fluid is directed toward the medial aspect of the affected thigh. The therapeutic pad 800, shown in FIG. 10, may be applied to the treatment of edema affecting the right thigh. However, the pad 800 may be constructed such that the pad 800 can be turned over and used to treat the left thigh—for example, by using a bladder portion of the pad that is detachable from the outer wrap.

Figure 11:
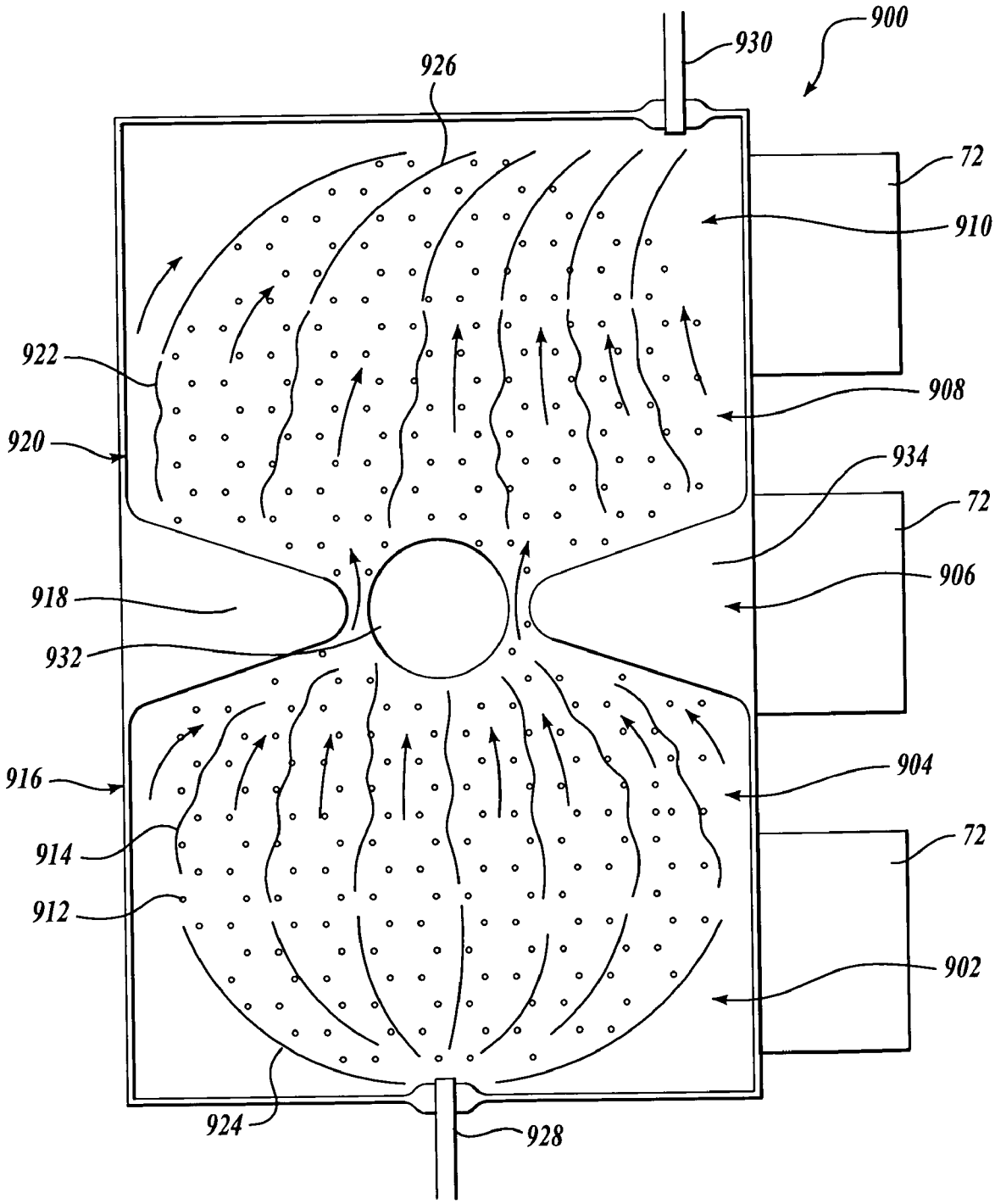
FIG. 11 shows an embodiment of the therapeutic pad of the present invention adapted for the knee.

FIG. 11 shows an embodiment of a therapeutic pad 900 according to the present invention that is intended to treat edema affecting the knee, and extend to portions of the user's calf and thigh (not shown). The pad 900 includes an inner bladder 920 and an outer wrap 916 attached to the bladder 920. The configuration as shown in FIG. 11 is intended to be used on the user's right knee. However, it will be readily appreciated that the pad 900 may be designed such that the bladder 920 can be turned over, to allow the same pad 900 to be used for the left knee.

The inlet manifold 902 includes seal lines 924 that generally disperse or distribute flow entering the pad 900 through the inlet port 928. In the distal center section 904 and the proximal center section 908, the seal lines 914, 922 are positioned to generally direct the flow parallel to the flow paths of lymph fluid in the portion of the user's calf and thigh that is covered or wrapped by the pad 900. In the distal segment of the lower limb, lymph flows in a relatively parallel path from the distal. Lymph from the medial and lateral aspects of the calf converges over the anterior calf and also flows from the distal to proximal calf. Seal lines 926 in the outlet manifold 910 direct the flow generally toward the outlet port 930. Spot welds or attachments 912 in the bladder 920 further define the flow paths in the bladder.

A circular cutout 932 is preferably provided in the middle of the center section 906 of the therapeutic pad to expose part of the patella. Oppositely-disposed tapered slits 918 and 934 are provided on both sides of cut-out 932 to allow the pad to remain in proximate contact to the skin as the knee joint is moved from flexion to extension, and vice versa. The taper helps to direct the circulating fluid toward the inner aspect of the pad as it flows from the calf toward the patella, and then distributing the fluid along the various flow paths over that portion of the therapeutic pad covering the thigh.

Figure 12:
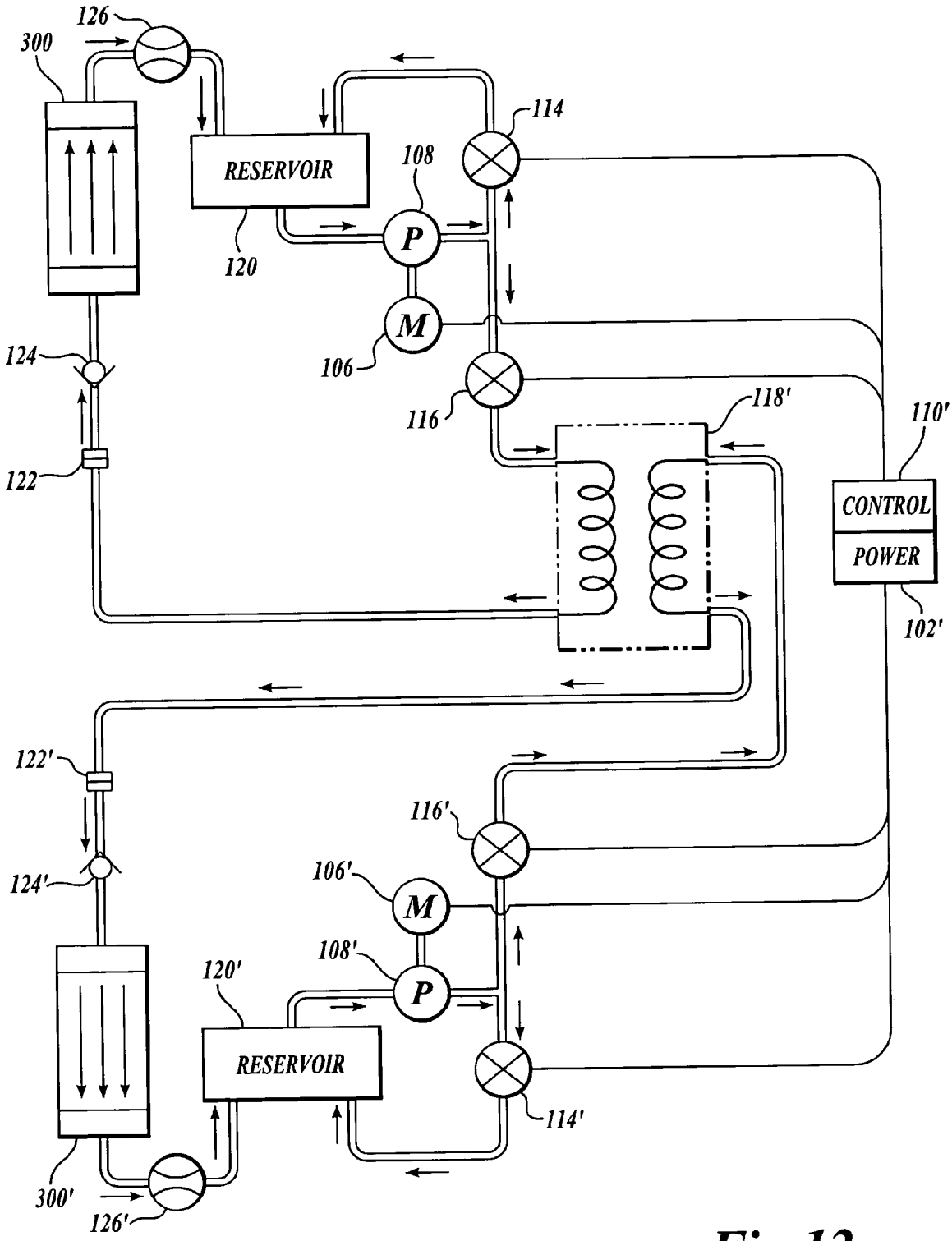
FIG. 12 shows a schematic of another embodiment of a therapeutic pad system according to the present invention, utilizing multiple pads.

Thus far, single pads have been disclosed for the treatment of edema affecting a specific area of the body. It is also contemplated that two or more pads may be placed in series, such that the pads can be activated in any desired sequence, simultaneously, continuously, and/or in overlapping sequence. For example, the pad located most proximally may be activated first to cause proximal clearing of edema, which, in turn, will facilitate clearing of edema by the more distally placed pads. The pressure pulse period may be different in the various pads, for example the pressure pulse period in the distal pad may be half the period of the proximal pad. FIG. 12 shows a schematic of one possible configuration of the present invention utilizing multiple pads arranged in series.

A pair of pads 300, 300' is shown in two generally separate but overlapping fluid circuits. The present invention may include more than two pads. The two fluid circuits share a heat exchanger 118', power supply 102', and control system 110'. The remaining components are generally the same as the corresponding elements shown in FIG. 4 and described above, including valves 114, 114', 116, 116', 124, 124', couplings 122, 122', reservoirs 120, 120', flow restrictors 126, 126', motors 106, 106', and pumps 108, 108'. Alternatively, a single motor and/or pump may be used, particularly if the pads 300, 300' are to receive flow sequentially, rather than simultaneously, or if a reduced flow is desired for simultaneous operation.

The control system 110' controls the valves 114, 114', 116, 116', and motors 106, 106' to achieve the desired flow pattern through the pads 300, 300'. Although not indicated in FIG. 12, it will be apparent that the control system might also control other aspects of the system, such as the fluid temperature. It is also contemplated that separate heat exchangers may alternatively be used each pad 300, 300', whereby different temperatures may be applied by each pad. This system provides great flexibility in the pressure treatment to be applied to the user.

Figure 13:
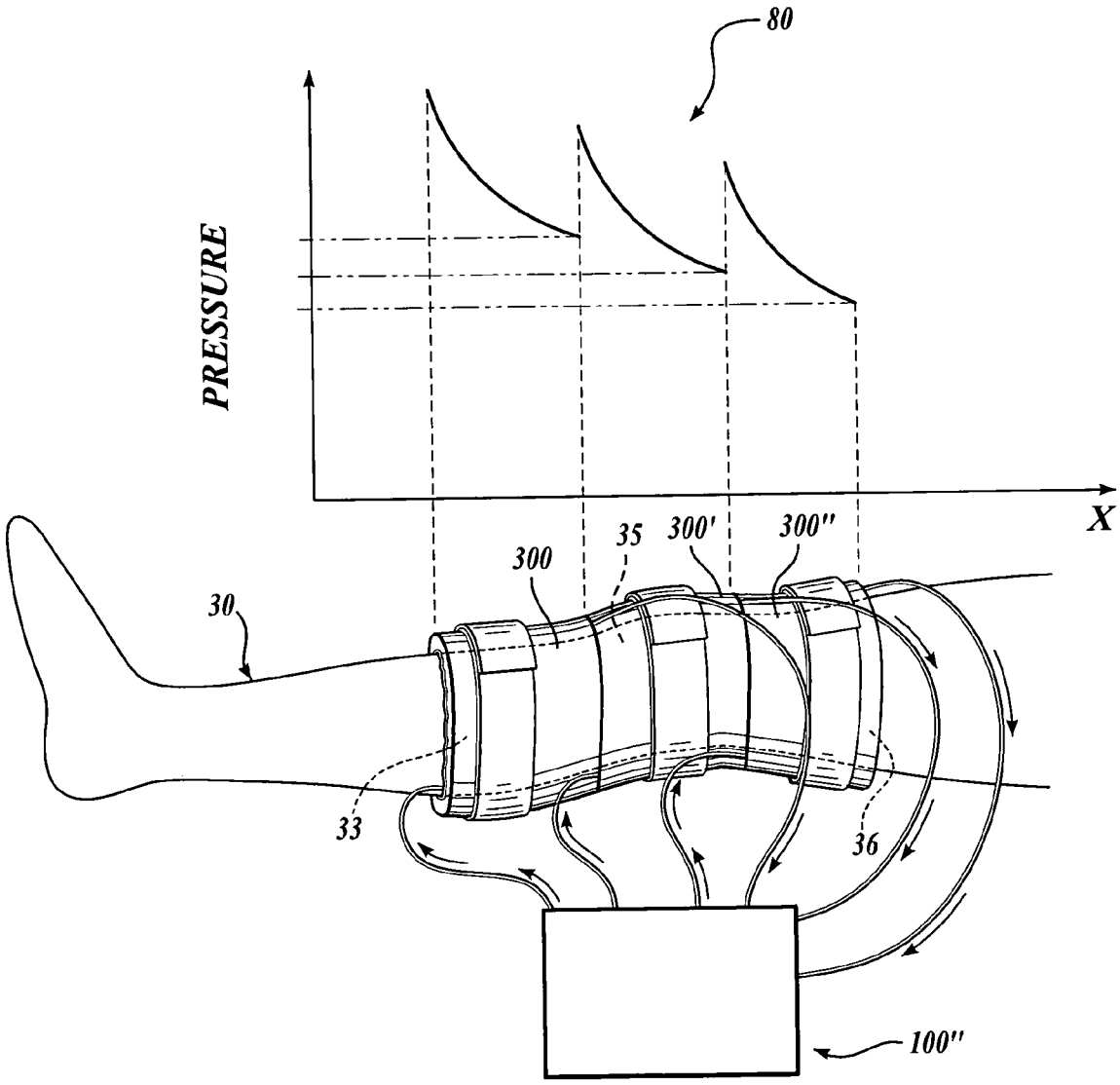
FIG. 13 illustrates the therapeutic pad system of FIG. 12, applied to the limb of a user and showing in general an idealized steady-state pressure profile that may be applied to the user when a fluid pressure is applied.

For example, FIG. 13 depicts a system utilizing three pads 300, 300', and 300", shown wrapped about a user's leg 30, wherein pad 300 is placed distally about the user's calf 33, pad 300' is placed generally about the user's knee 35 and pad 300" is placed proximally about the user's lower thigh 36. A pressure profile 80 shows an idealized steady state, transversely averaged pressure profile for each of the three pads. The desired distal-to-proximal pressure profile is shown. In another modality, the therapeutic pads 300, 300', and 300" may be pressurized sequentially, to provide a transient pressure pulse that travels generally up the user's limb. In yet another modality it may be preferable to pressurize the pads one at a time—for example, pressurizing the most proximal pad 300" for a period of time, to reduce the proximal swelling, then to pressurize the middle pad 300' for a period to reduce swelling in the middle region, and finally to pressurize the most distal pad 300 for a period. It will be appreciated that pressurization of the individual pads may include pulsing the flow through the pad to produce a transient pressure pulse, as discussed above. The sequencing and operation of the pads 300, 300', 300" are controlled by the control system 110', and may provide any or all of the described modalities.

It will be readily appreciated, and is contemplated by the present invention, that the multiple pads 300, 300', and 300" may be constructed either as physically separate pads as shown schematically in FIG. 12, providing greater flexibility—for example, by permitting the pads to be spaced apart or overlapped. Alternatively the multiple pads may be made as a unitary assembly having multiple fluid flow compartments with individual inlet ports and outlet ports as indicated in FIG. 13, such that a single assembly is wrapped about the user. The unitary assembly construction would be easier to apply and provide a predetermined relative positioning of the multiple pads.

Although the therapeutic pads disclosed above, utilizing a directional fluid flow through a bladder, are described in a substantially stand-alone system, it has been found that the efficacy of such therapeutic pads may be augmented in a system that includes in combination, a therapeutic pad as taught above, a resilient and compressible liner, and a compressive outer binder, as in the exemplary embodiment described below.

Figure 14:
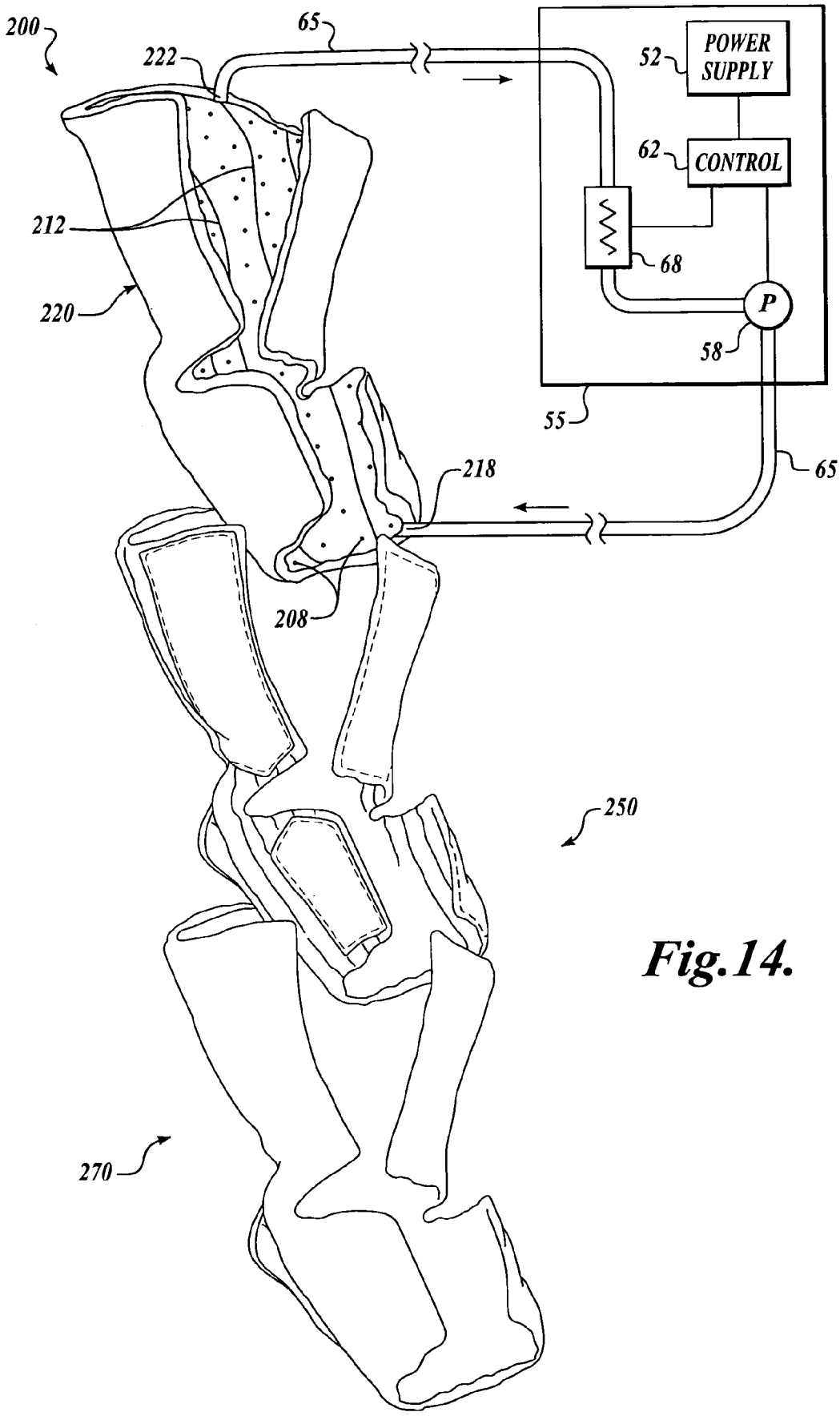
FIG. 14 is an exploded perspective view of an embodiment of the present invention in a system including a therapeutic pad with directional fluid flow, a liner, and an external binder, wherein the control system is shown schematically.

FIG. 14 shows an exploded view of a therapeutic pad system 200 adapted for use about a user's foot and ankle, the system 200 including a directional flow bladder or therapeutic pad 220, similar to the pads described previously. In this embodiment a liner 250 is provided that is sized and shaped to generally wrap about the therapeutic pad 220, and a relatively rugged outer covering, or binder 270, that wraps about the liner 250. This system 200 enhances the therapy provided by the pad 220 alone. In particular, the liner 250, compressively held in place by the binder 270, modifies or superimposes a pressure profile over the pad 220, which is thereby applied to the user by the pad 220. The binder 270 is preferably designed to provide the user with a wide range of options for selectively controlling the application of this pressure, while also providing a relatively rugged, protective outer covering for the system 200. The preferred liner 250 and binder 270 are discussed in more detail below.

It will be appreciated that the benefits of the directional fluid flow through the bladder-type pad 220, i.e., the generally distal-to-proximal pressure profile, is retained in this system 200. As shown schematically in FIG. 14, the pad 220 includes a console 55, containing the power supply 52, pump 58, control 62, and heat exchanger 68 for circulating a fluid through the pad 220. The pad 220 receives the circulating fluid through a distal inlet port 218, and expels the fluid through a proximal outlet port 222. A plurality of spot welds 208 and heat seal lines 212 are provided to guide the fluid flow through the pad 220. The liner 250 is shaped to wrap about the pad 220, and the binder 270 is shaped to wrap about the liner 250 and pad 220.

Figure 15:
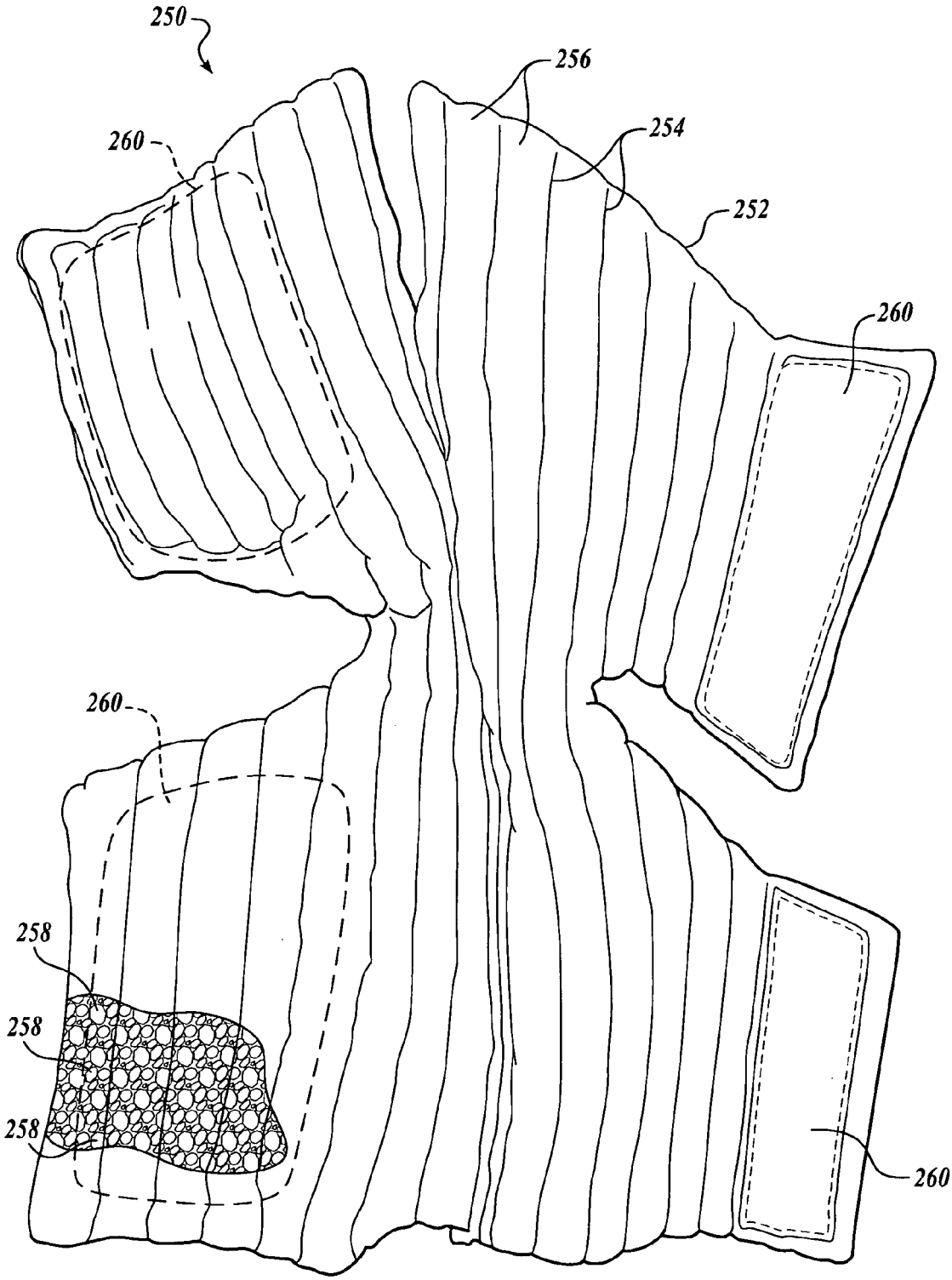
FIG. 15 is a perspective, partially cut away view of the liner shown in FIG. 14.

FIG. 15 shows a partially cut-away view of the liner 250, positioned generally for reception of the user's foot and ankle (not shown). Although the present embodiment is shaped and adapted to be wrapped about the foot and ankle of a user, it will be appreciated that the present invention may alternatively be applied to other portions of a user's anatomy. The liner 250 is preferably constructed in a manner sometimes referred to in the art as a "chip bag," "muff," or "Schneider pack." An example of a suitable liner is the product marketed by Innovative Medical Solutions, Inc. under the trademark Jovi PAK™.

The liner 250 includes a soft and flexible outer layer 252 defining a soft container. The outer layer may be made from cotton or from a suitably comfortable natural or manmade material. The outer layer 252 is filled with a number of irregularly shaped, resilient foam pieces or chips 258. A number of seams 254—for example, the generally parallel, longitudinal seams 254 shown in FIG. 15—forms a plurality of elongate channels 256 in the liner 250. The channels 256, being filled with the resilient foam pieces 258, are compressible. Therefore, when the liner 250 is affixed tightly about a user's foot, the liner 250 will apply a relatively gentle, secondary pressure profile on the user. Although the preferred liner 250 has been described, it is also contemplated that an alternative flexible liner construction may be used, including, for example, a liner comprising a sealed outer layer and containing a compressible material such as a gas or compressible gel.

The liner 250 includes a clasping mechanism—such as hook-and-loop type fasteners 260—such that the liner 250 may be secured about the foot and ankle of a user (not shown). Although it is preferred to have a clasping mechanism 260, it will be readily apparent that the liner 250 may alternatively rely on the binder 270 for securement about the user.

The liner 250, filled with the plurality of foam pieces 258, provides a comfortable and resilient wrap that adapts to and accommodates the complicated anatomical geometry of the human foot and ankle. The pressure applied by the liner 250 and augmented by the binder 270 is diffused somewhat by the therapeutic pad 220 interposed between the user and the liner 250.

Figure 16:
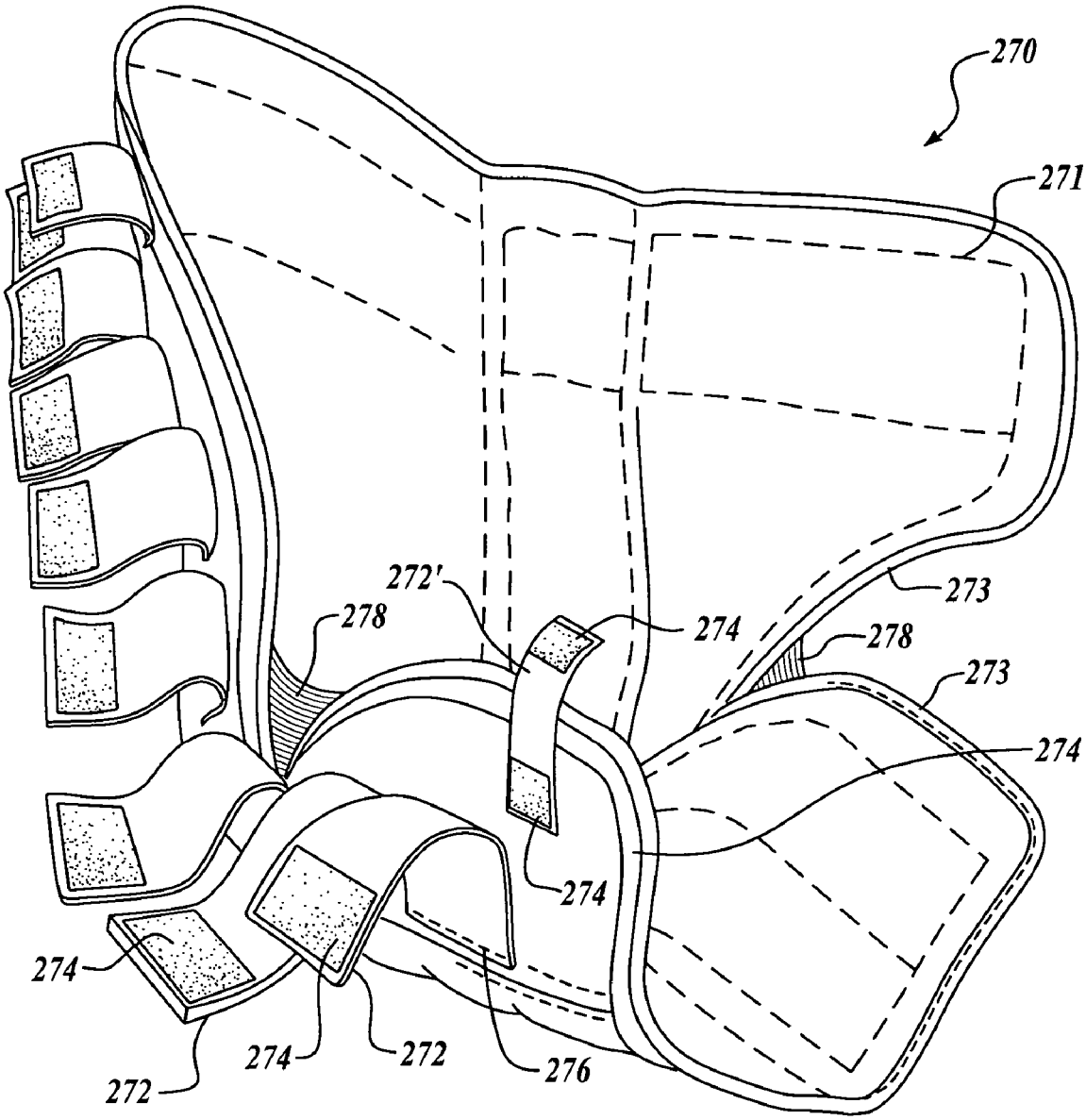
FIG. 16 is a perspective view of the binder shown in FIG. 14.

FIG. 16 shows a perspective view of the, binder 270 in isolation. The binder 270 includes a main body portion 271 that provides a relatively rugged outer covering for the system 200. The body portion 271 may be shaped similarly to the liner 250, such that the body portion 271 is adapted to wrap about the foot and ankle of the user, generally over the liner 250. A number of straps 272 are provided and adapted to fasten to the body portion 271, generally along across a vamp portion 273. The straps 272 are preferably elastically stretchable, and provide a mechanism for selectively tightening the binder 270 about the user's foot and ankle. In the disclosed embodiment, the straps 272 include at least one end having a hook-and-loop type fastening material 274. At least a portion of the exterior of the binder 270 is covered with the mating portion of the fastening material 274. It is contemplated that the straps 272 may be fixedly attached to the binder at one end—for example, with stitches 276—whereby the user may simply pull the strap across the vamp portion to attach to the opposite side of the body portion 271. Alternatively, or in addition, removable straps 272' may be provided that have fastening material 274 attached at both ends, whereby the removable straps 272' may be used to secure the binder 270 in place. It will be appreciated that the removable straps 272' provide the user with many options for adjusting the securement of the binder 270 about the user's foot, particularly when the body portion 271 of the binder 270 is substantially covered with mating fastening material 274.

The body portion 271 of the binder may be made from a flexible, sewable material, such as a relatively thick nylon panel, composite panel, or the like. The fastening material 274 and straps may conveniently be attached to the body portion 271 by stitching, or any other suitable attachment method as are well known in the art. In the preferred embodiment, an elastic web 278 is attached at a middle edge of the body portion, generally holding the body portion in an L-shaped configuration.

Figure 17:
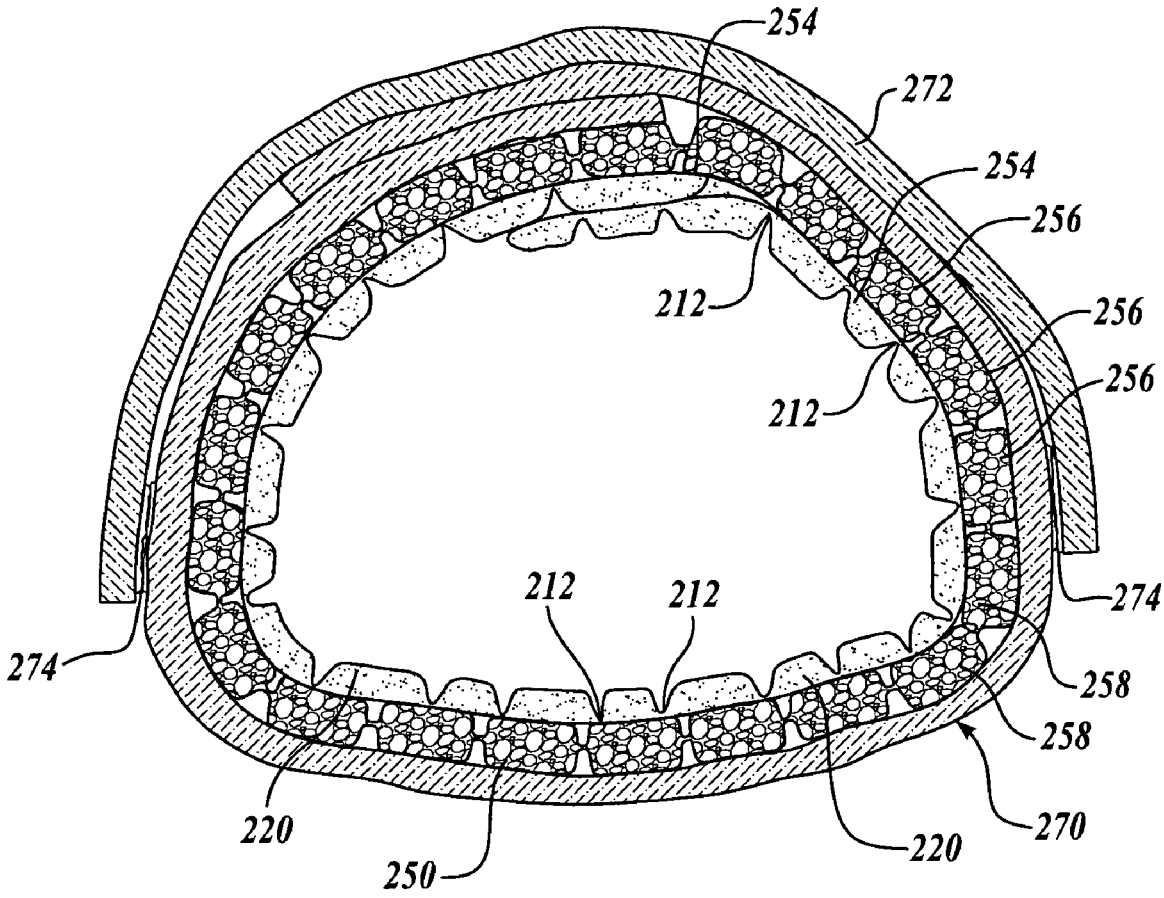
FIG. 17 is a cross sectional view of a portion of the system shown in FIG. 14 as it would appear wrapped about the foot and ankle of a user.

Referring now to FIG. 17, which shows a cross-section through the foot portion of the system 200 (with the foot removed for clarity), showing the therapeutic pad 220, liner 250, and binder 270. It will be appreciated that the liner channels 256 provide a relatively large-scale structure and corresponding pressure distribution based on the location of the seams 254. Additionally, within each channel 256, the irregular, resilient foam pieces 258 define a relatively small-scale pressure distribution. That is, the foam pieces 258 on a smaller scale, and the channels 256 on a larger scale, cause the applied pressure to alternate between a relatively high pressure and a relatively low pressure, thereby encouraging the flow of lymphatic fluids in the user. Movement by the user will cause the magnitude of the applied pressure and the specific locations of the applied pressure to vary, further encouraging the desired lymphatic flow in the user. Of course, the pad 220 with the directional fluid flow superimposes a distal-to-proximal pressure profile. The binder 270 is wrapped about the liner 250 and secured in place with straps 272' and the fastening material 274.

It will be appreciated that although this embodiment is described with reference to a foot and ankle wrap, the liner may be constructed to be applied about other portions of the anatomy. For example, the therapeutic pads for the shoulder, thigh, or knee of a user may be incorporated into a system including a liner and binder adapted for the particular needs of the corresponding pad. It is contemplated that the fluid and thermal system such as that contained in the console 55 (FIG. 14) may be interchangeable with a number of different therapeutic pads, so that a user may select the appropriate pad, liner, and binder for a particular need and attach the pad to a common fluid and thermal system.

Another benefit of the present invention is the flexibility provided by this system 200. It should be readily apparent that the system may be alternatively applied to the user in a number of different modalities to accommodate the particular needs and preferences of the user. It is contemplated, for example, that the user may beneficially wrap the liner 250 and binder 270 about the user's foot and ankle without the therapeutic pad 220—for example, when the user is moving around and does not want to be attached to the fluid console 55 and related components. The liner 250 and binder 270 will provide support and enhance lymphatic circulation, albeit without the benefits of the directional flow pad 220. It is also contemplated that in some instances it may be desirable to reverse the relative positions of the liner 250 and the therapeutic pad 220, so that the relatively soft liner 250 is adjacent to the user's foot, and the pad 220 is disposed about the liner 250. This may be desirable, for example, to provide a more diffuse thermal treatment from the therapeutic pad 220, that is, if the therapeutic pad is providing a heat treatment, the heat may be diffused by the liner 250 before being applied to the user. Similarly, it may be beneficial to apply only the therapeutic pad 220 with the binder 270 to the user, without the liner 250. This modality may be desirable, for example, where it is beneficial to apply a more direct pressure to the user's ankle, without the softening attributes of the liner 250.

It is contemplated that the system 200 may be adapted to incorporate the variations on the therapeutic pad taught previously, including, for example, the use of heat seal lines and spot welds to direct the flow of the fluid through the bladder, the use of a pulsed fluid flow, and/or the use of multiple bladders. The system 200 disclosed herein, therefore, provides a very flexible treatment system.

While the preferred embodiment of the invention has been illustrated and described, it will be appreciated that various changes can be made therein without departing from the spirit and scope of the invention.

The embodiments of the invintion in which an exclusive property or privilege is claimed are defined as follows:

1. A therapeutic pad system comprising:

a bladder defining a flow space for a fluid, the bladder having a distal portion with an inlet port into the flow space, and a proximal portion with an outlet port from the flow space such that during use a pressure gradient is produced across the bladder from a relatively high distal pressure to a relatively low proximal pressure;

a pump disposed in a fluid circuit with the bladder, the pump operable to circulate a fluid through the bladder, providing the fluid through the distal inlet port and receiving the fluid from the proximal outlet port;

a separable flexible liner adapted to wrap about the bladder, the liner having a plurality of compressible channels; and a separable binder adapted to wrap about the flexible liner, the binder having a plurality of elastic straps;

wherein the bladder, separable liner, and separable binder may be used in different combinations to provide different treatment modalities.

2. The system of claim 1, wherein the compressible channels are substantially filled with foam pieces.

3. The system of claim 1, wherein the bladder is adapted to be secured about a portion of the leg of a user.

4. The system of claim 1, further comprising a thermal modulation unit for controlling the temperature of the circulated fluid.

5. The system of claim 4, wherein the bladder further comprises a plurality of flow directing blockages for directing the flow of the fluid through the bladder.

6. The system of claim 5, wherein the flow directing blockages comprises a plurality of seal lines, and wherein the seal lines are oriented to direct the fluid flow to generally align with the direction of the user's lymph flow.

7. The system of claim 4, wherein the thermal modulation unit is a heat exchanger adapted to cool the circulated fluid to a desired temperature.

8. The system of claim 7, wherein the heat exchanger is operable to cool the circulating fluid to a temperature between 32 degrees Fahrenheit and 70 degrees Fahrenheit.

9. The system of claim 4, wherein the thermal modulation unit beats the circulating fluid.

10. The system of claim 8, further comprising a control system for controlling the rate of flow of the fluid to the bladder.

11. The system of claim 10, wherein the control system also controls the temperature of the fluid.

12. The system of claim 1, wherein the pump is adapted to provide a pulsed fluid flow to the inlet port of the bladder, such that a higher fluid pressure is periodically supplied to the inlet port.

13. The system of claim 12, wherein the pulsed fluid flow has a duration that is approximately equal to the transit time for the fluid through the bladder.

14. The system of claim 1, wherein the therapeutic pad comprises a plurality of bladders, each bladder having an inlet port and an outlet port, and wherein the pump is operable to provide fluid under pressure to each of the inlet ports.

15. The system of claim 14, further comprising a control system and wherein the control system is adapted to selectively control which of the inlet ports of the plurality of bladders receives fluid from the pump.

16. The system of claim 10, further comprising a portable power supply, and wherein the control system and portable power supply are disposed in a console.

17. The system of claim 1, wherein the fluid comprises a mixture of about 80% by volume of deionized distilled water and about 20% by volume of isopropyl alcohol.

18. The system of claim 1, wherein the therapeutic pad system is adapted to substantially cover a shoulder of a user, the bladder including flow deflection means that are adapted to direct the flow of the fluid proximally and generally along a lymphatic pathway through the shoulder.

19. The system of claim 18, wherein the bladder comprises a first bladder portion having a first inlet port and a first outlet port, and a second bladder portion having a second inlet port and a second outlet port, wherein the first and second bladder portions are not in direct fluid communication.

* * * * *

UNITED STATES PATENT AND TRADEMARK OFFICE

CERTIFICATE OF CORRECTION

PATENT NO. : 7,306,568 B2
APPLICATION NO. : 10/798713
DATED : December 11, 2007
INVENTOR(S) : R. Diana It is certified that error appears in the above-identified patent and that said Letters Patent is hereby corrected as shown below:

| COLUMN | LINE | ERROR |
|---|---|---|
| 17 (Claim 9) | 5 | "beats" should read --heats-- |

Signed and Sealed this

Sixth Day of May, 2008

JON W. DUDAS
*Director of the United States Patent and Trademark Office*